United States Patent [19]

Ramsay et al.

[11] Patent Number: 5,044,281

[45] Date of Patent: Sep. 3, 1991

[54] SUBMARINE FLARE WITH VERTICAL ATTITUDE DETERMINATION

[75] Inventors: Peter Ramsay, Oak Park; Brian W. Whiffen, Pascoe Vale; Gerald M. Bushnell, Gordon; Victor Nanut, Forest Hill; Robert C. Czigledy, North Balwyn; Robert J. Swinton, Ascot Vale; Maxwell J. Coxhead, Pascoe Vale; Timothy R. Clarke, Ringwood, all of Australia

[73] Assignee: The Commonwealth of Australia, Canberra, Australia

[21] Appl. No.: 334,278

[22] PCT Filed: Aug. 21, 1987

[86] PCT No.: PCT/AU87/00285

§ 371 Date: Apr. 7, 1989

§ 102(e) Date: Apr. 7, 1989

[87] PCT Pub. No.: WO88/01364

PCT Pub. Date: Feb. 25, 1988

[30] Foreign Application Priority Data

Aug. 21, 1986 [AU] Australia ..... PH7612

[51] Int. Cl.[5] ..... F42B 4/28

[52] U.S. Cl. ..... 102/340; 102/351; 102/354; 102/357; 102/224

[58] Field of Search ..... 102/340, 351, 354, 357, 102/224

[56] References Cited

U.S. PATENT DOCUMENTS

| | | | |
|---|---|---|---|
| 2,966,849 | 1/1961 | Joiner | 102/7 |
| 3,199,453 | 8/1965 | Fasig et al. | 102/7 |
| 3,262,387 | 7/1966 | Reams | 102/16 |
| 3,440,960 | 4/1969 | Reams | 102/16 |
| 3,670,692 | 6/1972 | Jackson | 102/37.6 X |
| 4,164,186 | 8/1979 | Beatty et al. | 102/37.8 |
| 4,335,656 | 6/1982 | Beatty et al. | 102/340 |

*Primary Examiner*—Peter A. Nelson

*Attorney, Agent, or Firm*—Finnegan, Henderson, Farabow, Garrett & Dunner

[57] ABSTRACT

A flare (1) for submarine use. The flare (1) is caused to be deployed from a submarine location where it will rise to the surface of the water because of its buoyant casing. A hydrostatic valve means (147) is provided within the casing and it opens when the flare is at or near the surface of the water to render said flare ready to project a flare composition (5) into the air. The hydrostatic valve means (147) is held inoperative by a latch mechanism (51) which is tripped as the flare is deployed from a firing tube at the submarine location. The flare composition (5) cannot be projected into the air until the flare (1) is within a range of vertical attitude determined by inclination means (13). The flare composition (5) cannot be projected into the air until the nose is above water. The flare (1) thus has a sensor (23) at its forward nose to determine that the nose is above the water. A time delay means (87) is provided which is initiated by a pyrotechnic medium (85) used to project the flare composition (5) into the air, to delay ignition of the flare composition (5) until it has at least cleared the surface of the water.

36 Claims, 17 Drawing Sheets

1
3
5
7
9
10
11
13
15
16
17
19
21
23

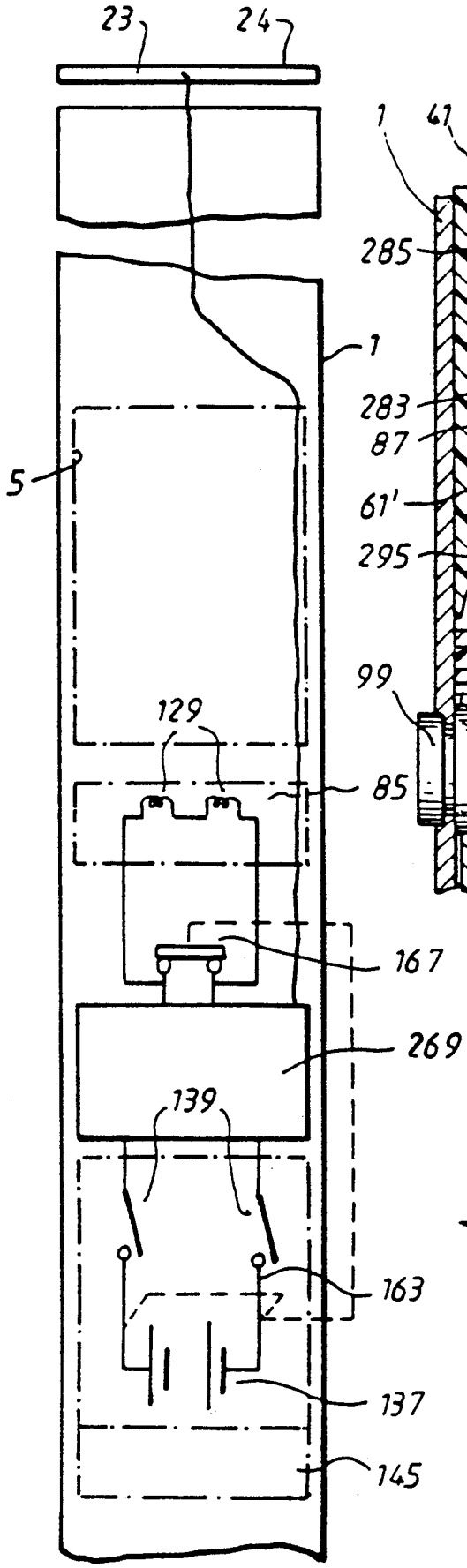
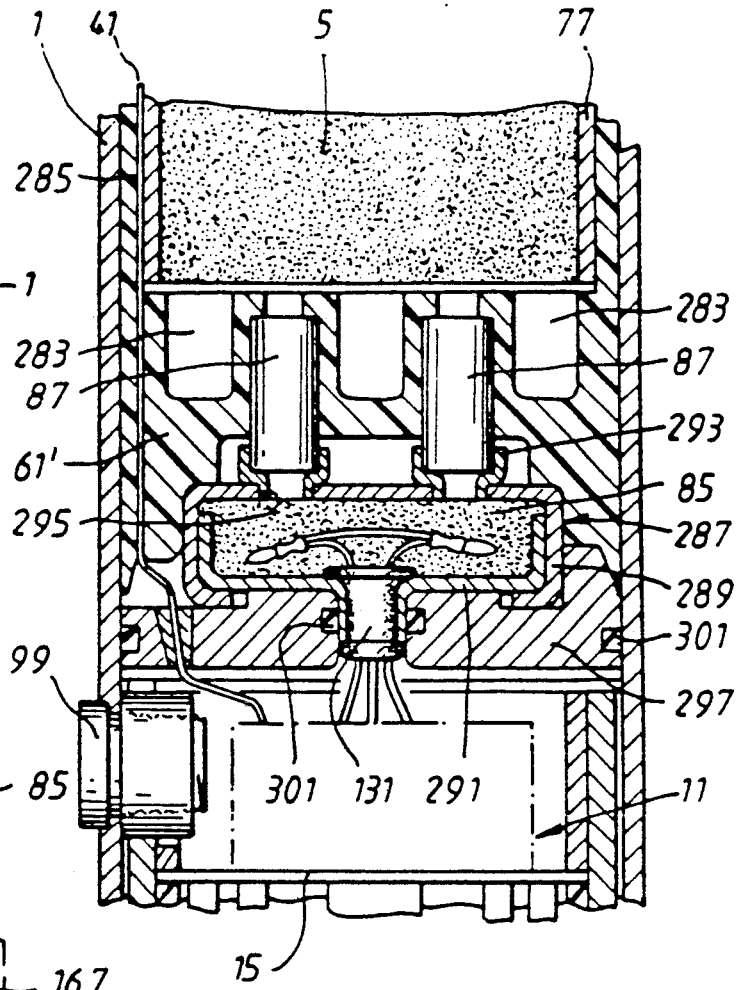
FIG. 23.
FIG. 19.

SUBMARINE FLARE WITH VERTICAL ATTITUDE DETERMINATION

BACKGROUND OF THE INVENTION

This invention relates to submarine flares and relates particularly, but not exclusively, to such which can be released from submarine vessels, such as military submarines used for warfare or from other vessels which travel underwater.

DESCRIPTION OF PRIOR ART

Hitherto it has been known to release flares from submarine vessels. One such flare is permitted to float to the surface of the water where it can give a visual display. A problem with such flares is that they operate only on the surface of the water and accordingly the range at which they can be observed is quite minimal.

Another such flare is permitted to float to the surface of the water whereupon it is fired into the air where it can give a visual display and thus be observed from a greater range. A problem with such flares is that they do not always fire vertically into the air from the sea surface as waves can tilt the flare and in some instances they can be fired generally horizontally. Thus the flares are not reliable for firing into the air so that they can be observed from a considerable range. Sometimes such flares are unintentionally discharged below water level in high seas states and thus do not reach the required altitude.

STATEMENTS OF THE INVENTION

The present invention has been devised to attempt to provide an improved flare.

Therefore according to a first broad aspect of the present invention there may be provided a flare for submarine use comprising a buoyant casing in which a flare composition is carried and from which said flare composition can be projected into the air when the flare is at or near the surface of the water, inclination means for sensing when the flare can be projected into the air in a direction within a range of vertical tolerance and means for projecting said flare composition into the air when said casing is at or near the surface of the water and means to ignite the flare composition so that it will provide a visible display in the air when so projected, said flare being releasable from a submarine location whereupon its buoyant casing will carry it towards the surface of the water where the flare composition can be projected into the air to give the visible display when ignited.

In accordance with a further aspect of the present invention there may be provided a flare for submarine use comprising a buoyant casing in which a flare composition is carried and from which said flare composition can be projected into the air when the flare is at or near the surface of the water, means for sensing when at least a forward nose end of the casing is above the surface of the water and means for then projecting said flare composition into the air, and means to ignite said flare composition so that it will provide a visible display in the air when so projected, said flare being releasable from a submarine location where its buoyant casing will carry it towards the surface of the water where the flare composition can be projected into the air to give the visible display when ignited.

In one embodiment the flare is provided with a time delay means so that said flare composition can be fired into the air to clear the surface of the water before said flare composition is ignited.

Preferably a cycle for the firing and ignition of said flare composition is initiated by operating a hydrostatic means when the flare reaches a point at to near the surface of the water.

In one particularly preferred embodiment the hydrostatic means is a valve which opens and exposes salt water batteries to salt sea water where they are then activated by the salt water. In this way, electrical power for an electronic control circuit used to commence said cycle is not available until the hydrostatic valve has opened and the batteries activated.

In one particularly preferred embodiment there is provided a latch mechanism which is operated during discharge of the flare from the submarine vessel. The latch mechanism is associated with the hydrostatic valve to inhibit operation of the hydrostatic valve until it is tripped. Most preferably the latch mechanism is associated with an outwardly biased secondary latch such that the latch mechanism is inhibited from operation until this secondary latch is moved and held inwardly within the flare casing against its bias. This is conventionally managed by causing the side walls of the firing tube in the submarine from which the flare is fired, to engage with the secondary latch and hold it inwardly of the flare casing. In this way, if the flare is accidentally dropped into sea water, within the submarine for example, then the latch mechanism cannot be accidentally activated to release the hydrostatic valve, because the spring biased secondary latch will not be held within the casing. In other words, the latch mechanism is provided with a secondary latch and both must be activated before the hydrostatic valve can be put into a condition whereby it can release and commence initiation of the firing cycle. In this way, if the flare is put into the firing tube on the submarine, and it is decided that that particular flare is not required but a further flare is required of different colour discharge, then the first flare can be removed from the flare firing tube and the secondary latch or trip lever will then operate to extend outwardly of the flare casing as it clears the bottom of the firing tube to, in turn, inhibit accidental release of the latch mechanism.

It is particularly preferred that said flare composition be projected into the air by a propulsion medium and that a time delay means be provided in association with that medium to ignite the flare composition after a certain time period so as to allow said flare composition to reach approximately the highest point in its trajectory before being ignited.

It is also particularly preferred that said cycle for the firing and initiation of the flare be electronically controlled by a control circuit carried in the casing.

BRIEF DESCRIPTION OF THE DRAWINGS

In order that the invention can be more clearly ascertained a preferred embodiment for use on submarines will now be described with reference to the accompanying drawings, wherein:

FIG. 19 is an overview diagram showing the functional components of the flare;

FIG. 23 is a side cross-sectional view of part of the flare showing a modification.

DETAILED DESCRIPTION OF PREFERRED EMBODIMENTS

(a) Overview of a Preferred Embodiment

Figures 1, 1A, 1B:
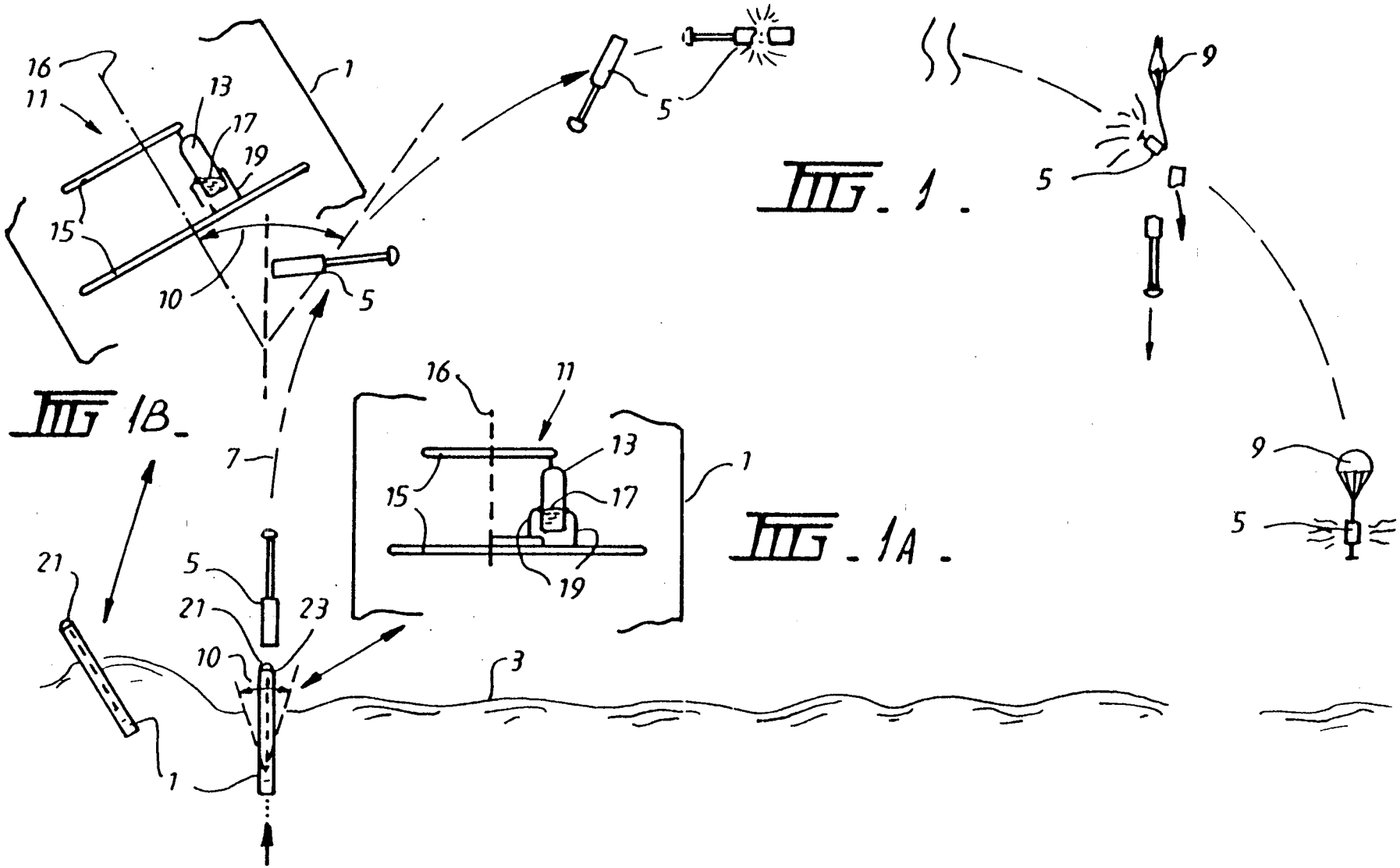
FIG. 1 is a schematic diagram of the flare showing how it is projected from the surface of the water to a particular altitude where the flare composition is ignited and then carried by parachute means towards sea level.
FIGS. 1*a* and 1*b* collectively show a inclination means used for inhibiting firing of the flare from the surface of the water unless the longitudinal axis of the flare is within a range of vertical inclination tolerance set within the inclination means.

Referring firstly to FIG. 1 there is shown an elongate flare casing 1 at the surface of the water 3. The flare casing 1 is disposed in a vertical attitude and it can be seen that a flare composition 5 has been fired from the flare casing 1. The flare composition 5 will follow the trajectory 7. The flare composition 5 is fired from the flare casing 1 by a burning type propulsion medium such as gunpowder. The physical shape of the fired assembly causes it to slowly tumble during its upward flight along the trajectory. A fuse or time delay (not shown in FIG. 1) is provided whereby the flare composition 5 will not be ignited by the burning of a pyrotechnic delay composition which is, in turn, ignited by the propulsion medium until the flare composition is at approximately the maximum altitude along the trajectory 7. This is shown generally at the top of the path of the trajectory shown in FIG. 1. When the flare composition 5 is ignited, the gas pressure thus generated causes a parachute 9 to be released from the assembly, and this carries the flare composition 5 slowly downwardly towards sea level. The assembly, apart from the flare composition 5 and the parachute 9, is separated by the gas pressure so generated.

In order that the flare composition 5 can be discharged upwardly along the trajectory 7 to reach the maximum altitude, the flare casing 1 should be in a range 10 of vertical attitude as shown in FIG. 1 prior to firing. Accordingly, inclination means 11 (see FIGS. 1A and 1B) is provided to sense when the flare casing 1 is within this range 10. The inclination means 11 comprises a mercury switch 13 which is mounted to circuit boards 15 within the flare casing 1. The circuit boards 15 are mounted so that the planes of the boards 15 are perpendicular to the longitudinal axis 16 of the flare casing 1 and so that mercury 17 within the mercury switch 13 (an inclination means) will bridge contacts 19 when the flare casing 1 is within range 10. This is diagrammatically shown in FIG. 1A. If a wave should tilt the flare casing 1, as shown in FIG. 1B, then the mercury 17 will not make contact across the pair of contacts 19 and thus a circuit will not be completed to enable initiation of firing of the flare composition 5. The degree of vertical tolerance permitted is determined by the degree of mercury filling provided in the mercury switch 13.

In order that the circuitry operates to permit a firing and ignition cycle to be carried out only when the nose end 21 of the flare casing 1 is above water level, a sensor 23 is provided to sense this condition. The sensor 23 comprises an electrode 24 (not shown in FIG. 1 but to be referred to later) which forms part of a salt water conductive path with the flare casing 1. Accordingly, an electric current is caused to flow through the sensor 23 through the salt water to the flare casing 1. When the nose end 21 is above water level, this conductive path is broken and the electric circuit is then electrically placed in a condition where the flare composition 5 can be ignited.

A cycle for the firing and ignition of the flare is initiated by operation of a hydrostatic valve (not shown in FIG. 1) and the hydrostatic valve when operated, in turn, allows salt water to surround the salt water batteries which are then activated and brought up to power. The hydrostatic valve opens to allow the salt water batteries to be moved into the salt sea water when the flare casing 1 is at or near the surface of the water.

A latch mechanism (not shown in FIG. 1) is provided and associated with the hydrostatic valve so that the hydrostatic valve is inhibited from operation until the latch mechanism is tripped during release of the flare from a firing tube in submarine vessel. A spring biased secondary latch (also not shown in FIG. 1) is associated with the latch mechanism so that the latch mechanism can be brought into an operative primed position only when the secondary latch is held inoperative. This occurs when the flare is placed in a firing tube within the submarine vessel by the secondary latch being held inwardly of the flare casing, against outwardly directed biasing forces, by the side walls of the firing tube. If the flare is removed from the firing tube, the secondary latch moves outwardly in the direction of the biasing forces and in turn, causes the latch mechanism to be in a non-primed position which inhibits the latch mechanism from being accidentally tripped.

A time delay is provided (not shown in FIG. 1) which operates in association with the propulsion medium to fire the flare into the air, so that the flare composition 5 is not ignited until it has travelled for a predetermined time. The predetermined time will be set having regard to the anticipated maximum height of the trajectory. In this way the flare composition 5 can be caused to be ignited when it is at approximately the maximum height of the trajectory.

(b) Detailed Description

Figure 2:
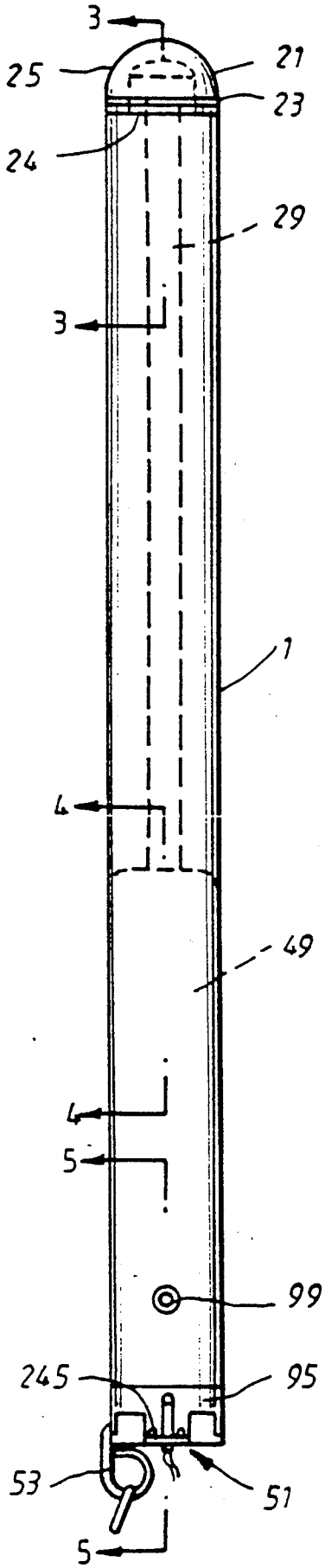
FIG. 2 is a side view of the flare.
Figure 3:
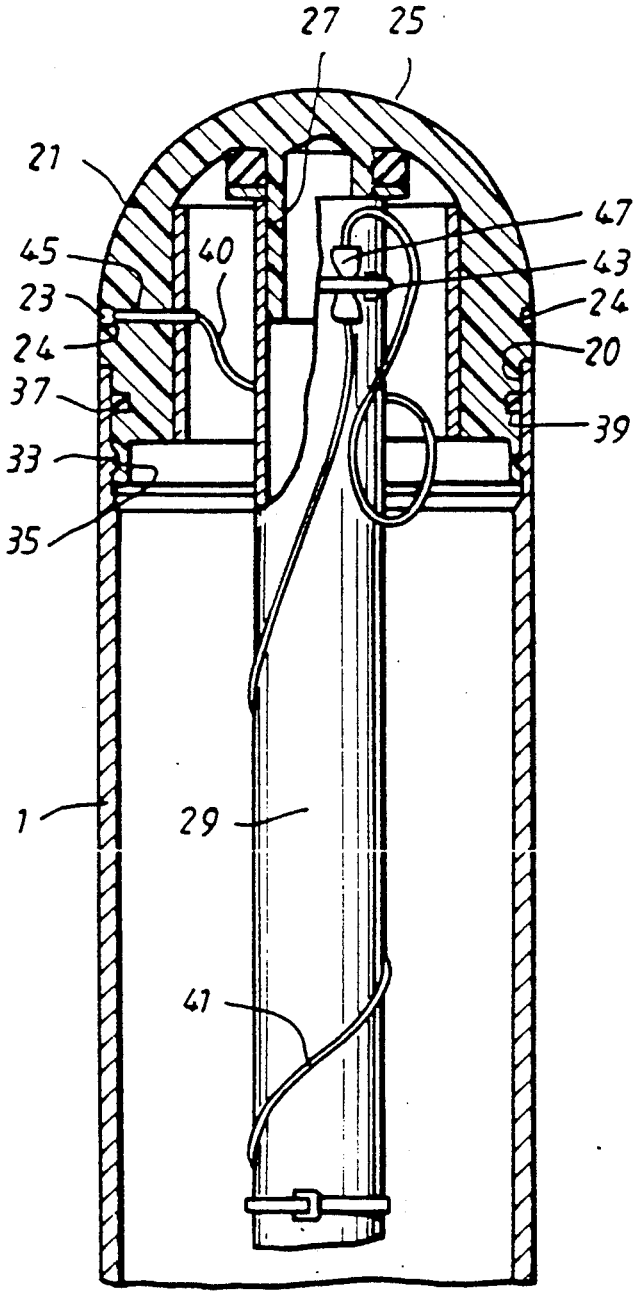
FIG. 3 is an enlarged side cross-sectional view of the nose part of the flare taken along line 3—3 of FIG. 2.

Referring now to FIGS. 2 and 3 can be seen that the flare casing 1 is hollow and elongate. Typically the flare casing 1 is made from aluminium. The nose end 21 of the flare casing 1 is provided with a nose 25 of plastics material such as polypropylene. The nose 25 is therefore an electrically insulating medium. A sensor 23 in the form of a brass ring 24 is also provided. The nose 25 is hemispherical and to assist in the reduction of material in its construction, it is hollowed but has an internal spigot 27. A push rod 29 of tubular conduit is force fitted onto the spigot 27 (as shown in FIG. 3). The purpose of the push rod 29 will be described in due course.

In FIG. 3 it can be seen that an internal rib 33 is provided at an enlarged internal diameter portion 20 at the nose end 21 of the flare casing 1. The nose 25 has a circumferential groove 35 which can snap lock with the rib 33 whereby to hold the nose end 25 captive to the flare casing 1. An "O" ring 37 is provided in a circumferential groove 39 in the nose 25 and inhibits water from entering between the nose 25 and the flare casing 1 to the hollow confines of the flare casing 1. An electrical lead 41 from sensor 23 is wrapped around the push rod 29 and clipped thereto by ties 43. The electrical lead 41 terminates with the sensor 23 through a passageway 45 which communicates with the sensor 23 and the inner cavity of the nose 25. The other end of the lead 41 terminates with an electrical circuit and circuit boards 15. This will be described later. A crimp connector 47 can be provided on the electrical lead 41 where tie 43 nearest the nose 25 engages therewith, whereby to enable the nose 25 and the sensor 23 to be made as a unit with a lead 40 extending from the ring 24. Thus lead 40 can be connected to lead 41 when the nose 25 is assembled to the casing.

Figure 5:
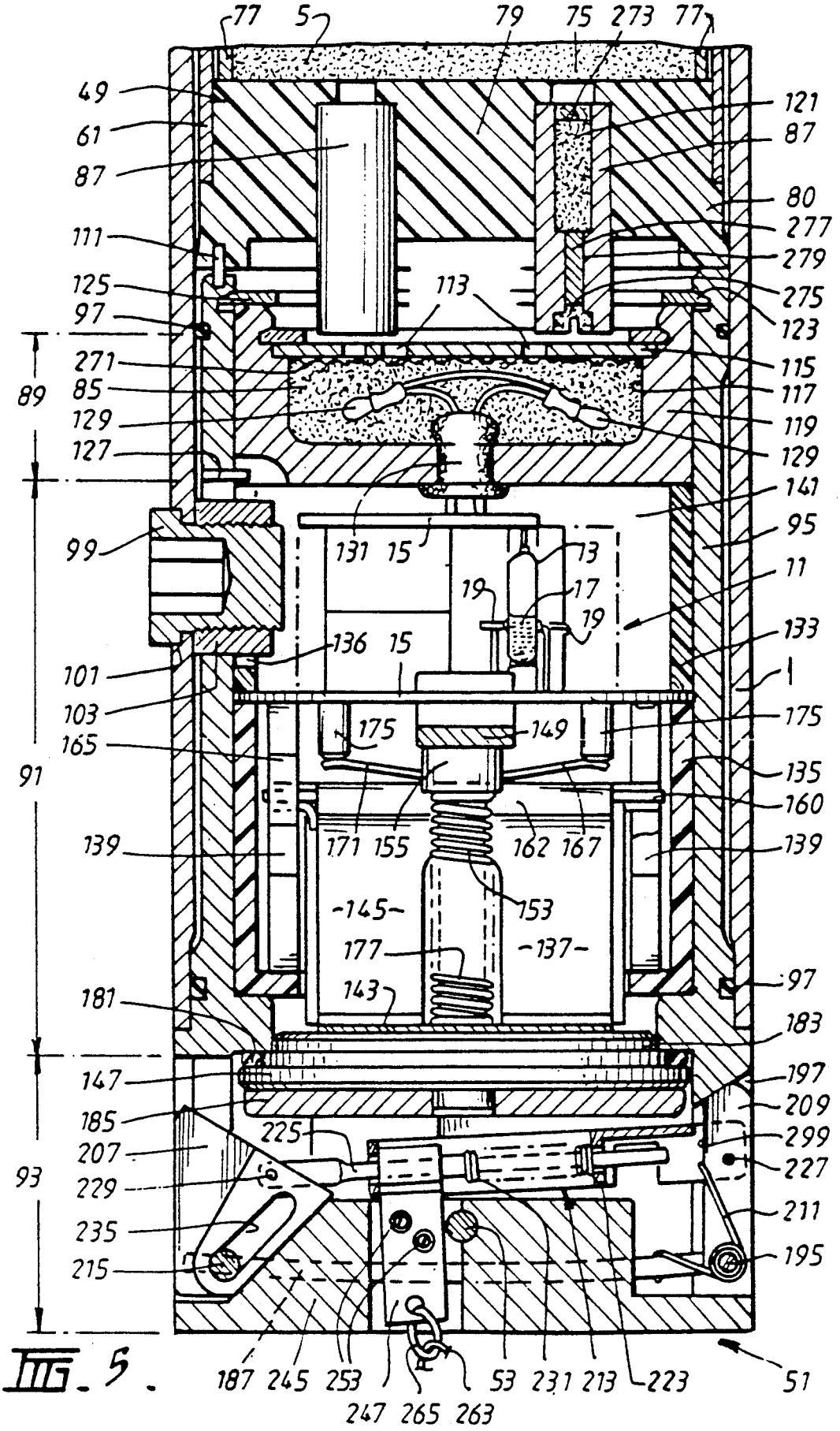
FIG. 5 is a side cross-sectional view taken along line 5—5 of FIG. 2.

In FIG. 2, the parachute 9 and the flare composition 5 are shown diagrammatically as pay load 49. A latch mechanism shown generally by numeral 51 in FIG. 2, is provided at the opposite end of the flare casing 1 to the nose end 21. The latch mechanism 51 is, in turn, held inoperative by a priming plug 245 (FIG. 5). The priming plug 245 is, in turn, held captive relative to the tube 95 by a safety pin 53. Typically the flare casing 1 is inserted into a firing tube of a submarine vessel following release of the safety pin 53, Withdrawal of priming plug 245, in turn, enables suitable priming of the latch mechanism 51 for the subsequent operation of the flare.

Figure 4:
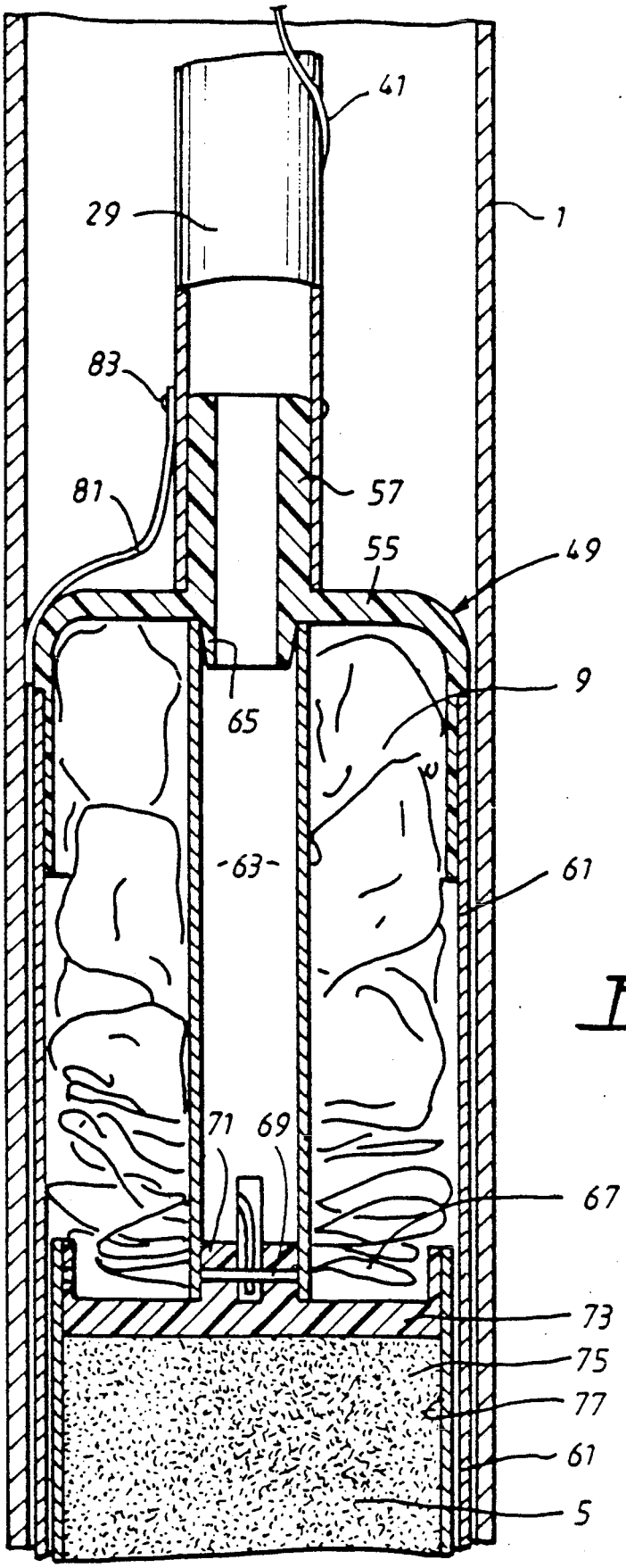
FIG. 4 is a side cross-sectional view taken along line 4—4 of FIG. 2.

Referring now to FIG. 4 there is shown a side cross sectional view taken along the line 4—4 of FIG. 2, and showing the detail of the parachute 9 arrangement. Here it can be seen that the push rod 29 terminates with a cup shaped member 55 and locates on a forwardly extending spigot 57 moulded integral with the cup shaped member 55. Typically, the cup shaped member 55 is made of a plastics material such as polypropylene. Side walls of the cup shaped member 55 are stepped whereby to provide a reduced diameter portion 59. A cardboard tube 61 is fitted over the reduced diameter portion 59. The parachute 9 is folded to be within the cardboard tube 61 and around a centrally located push tube 63. The push tube 63 is held to the cup shaped member 55 by locating about a central boss 65. The centre of the spigot 57 and the boss 65 is hollow to reduce the volume of the plastics material from which the cup shaped member 55 is made. The parachute 9 has a cable 67 attached thereto which is, in turn, tied to an anchoring pin 69 which is fitted transversely across a boss 71 of an end 73, as of plastics material, which closes a flare composition compartment 75. The compartment 75 is defined by the end 73, a cardboard tubular outer 77, and a further end 79 (see FIG. 5). Ends 73 and 79 are made from a plastics material such as polypropylene.

Referring now to FIG. 5, it can be seen that the end 79 is partly received within the end of the cardboard tube 61. It can also be seen, that the end 79 has a flared outer diameter at the tail end 80 which enables a pressure fit within the flare casing 1.

The pressure fit of the end 79 within the flare casing 1 is provided so that when a propulsion medium 85 is ignited, pressure can be built up within the flare casing 1 so that the pay load 49 can be fired into the air from the surface of the water. The pay load comprises the flare composition 5, and the parachute 9 as well as other items associated therewith.

The end 79 includes time delay means 87. The time delay means 87 is carried with the pay load 49 and permits the flare composition 5 to be ignited after a predetermined time delay after firing of the pay load 49 into the air, from the surface of the water. The time delay means 87 is ignited by a burning type propulsion medium 85 as will be described in due course. There are two time delay means 87 shown. Any desired number of time delay means 87 can be provided but two have been chosen as being the minimum number required for reliable ignition of the flare composition 5.

Referring now to FIG. 5 it can be seen that three separate zones are provided at the lower end of the flare casing 1. These zones are respectively a propulsion medium zone 89, and electric circuit zone 91 and a latch mechanism zone 93. The propulsion medium zone 89 and the electric circuit zone 91, are provided within a cylindrical metallic tube 95 as of aluminium. The tube 95 is provided with "O" rings 97 which seal the interior of the casing 1 from ingress of water. The "O" rings 97 also provide a propellant gas seal. The tube 95 is locked to the flare casing 1 by a bore riding bolt 99. The purpose of this will be described in due course. The bore riding bolt 99 passes through an aperture 101 in the flare casing 1 and into a screw threaded insert 103. The bore riding bolt 99 physically holds the tube 95 relative to the flare casing 1 so that when the propulsion medium 85 is ignited, the tube 95 will not eject from the flare casing 1, but rather the pay load 49 will be fired into the air. The bore riding bolt 99 is also provided for locating in a double keyway 107 (see FIGS. 8, 9, 10, 11, 16 and 17) which extends longitudinally along the internal side wall of the firing tube from which the flare is released from the submarine vessel. The bore riding bolt 99 therefore positively angularly locates the latch mechanism 51 relative to the double keyway 107.

Figure 8:
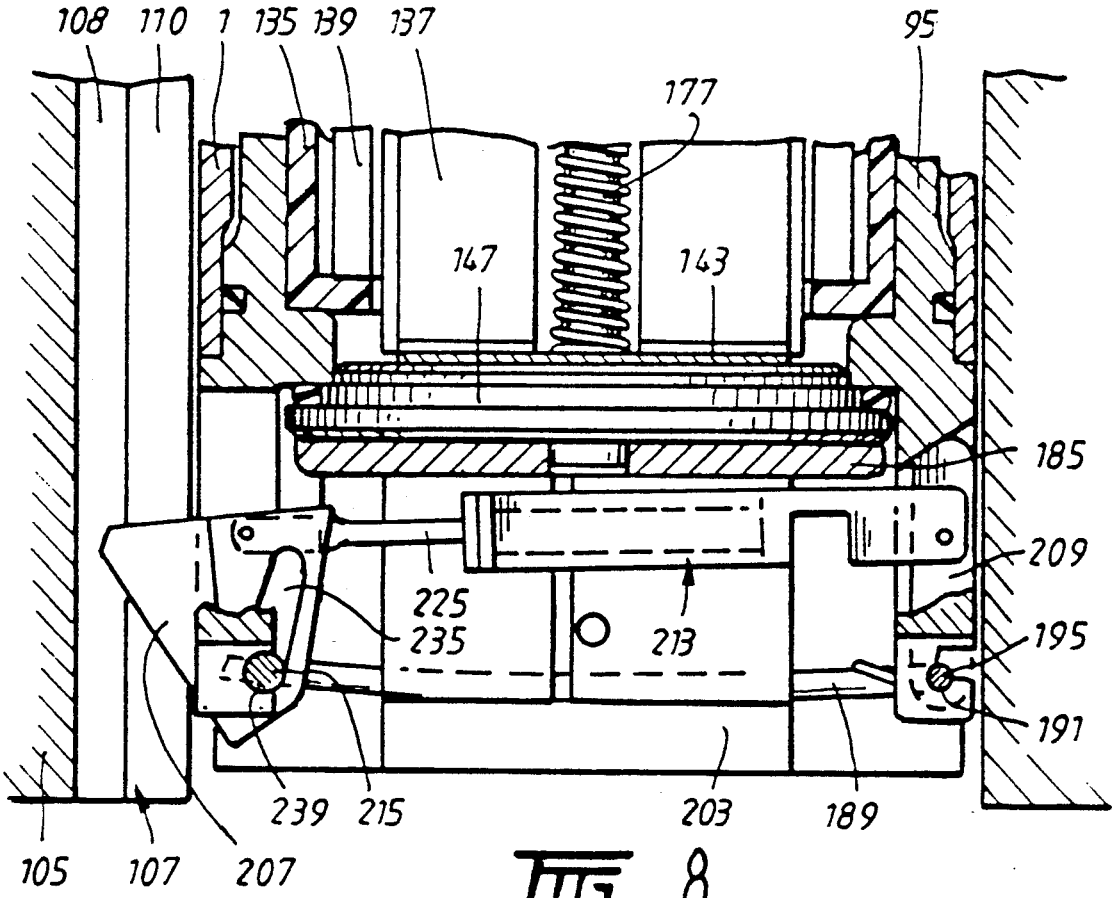
FIG. 8 is a side cross-sectional view of the flare showing a safety latch mechanism and a spring biased secondary latch.
Figure 9:
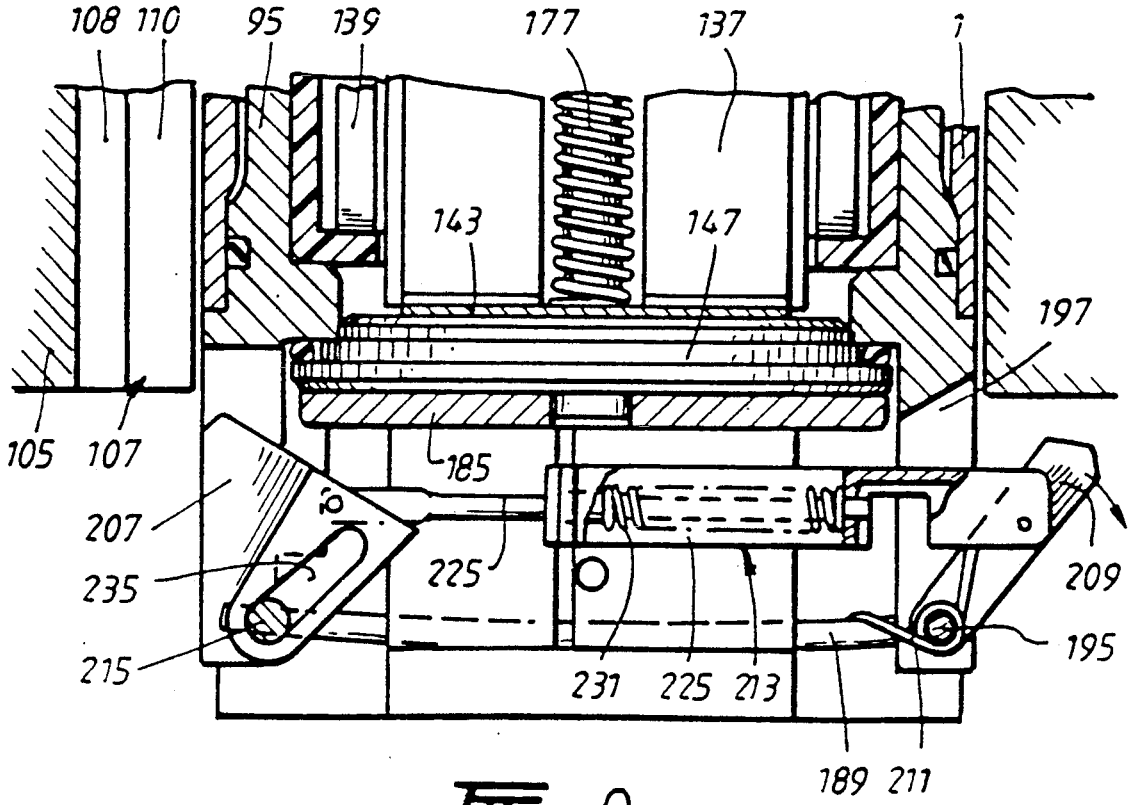
FIG. 9 is a view similar to FIG. 8 but showing the flare at a position immediately after removal from the firing tube.
Figure 10:
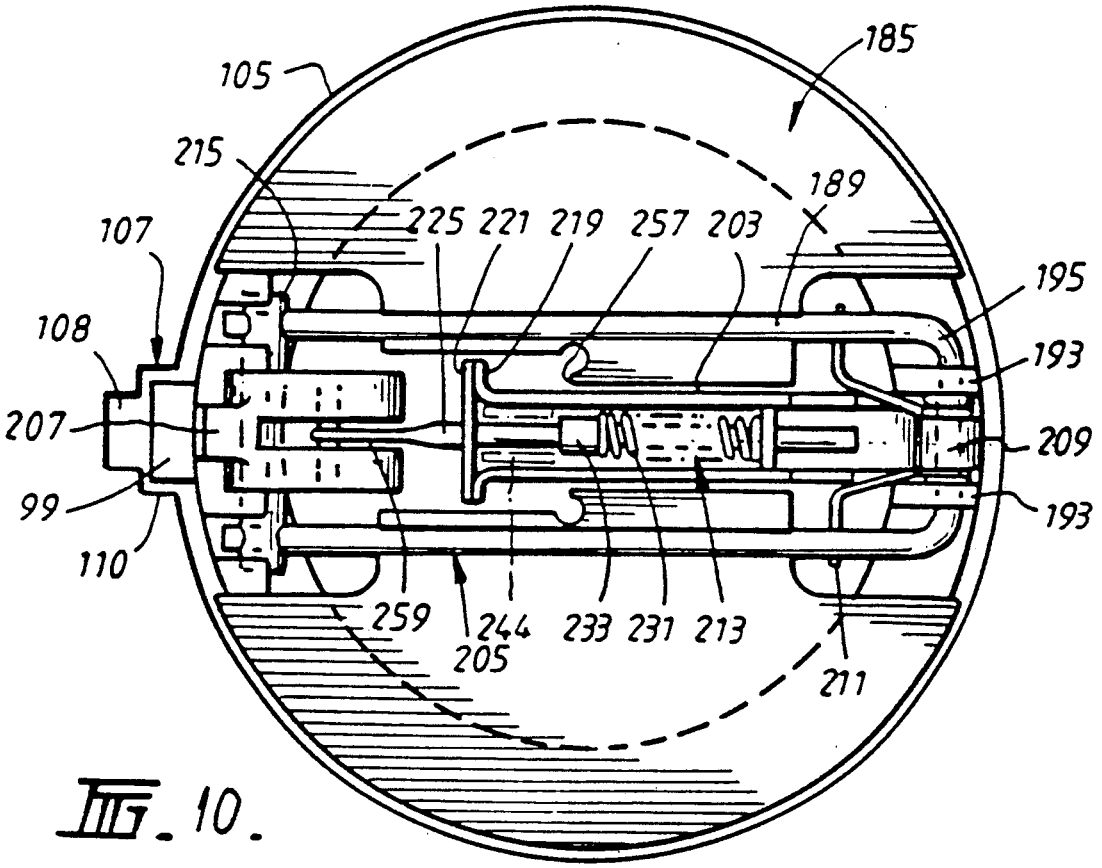
FIG. 10 is an underneath view of the flare showing insertion into the firing tube of the submarine and prior to removing a priming plug.
Figure 11:
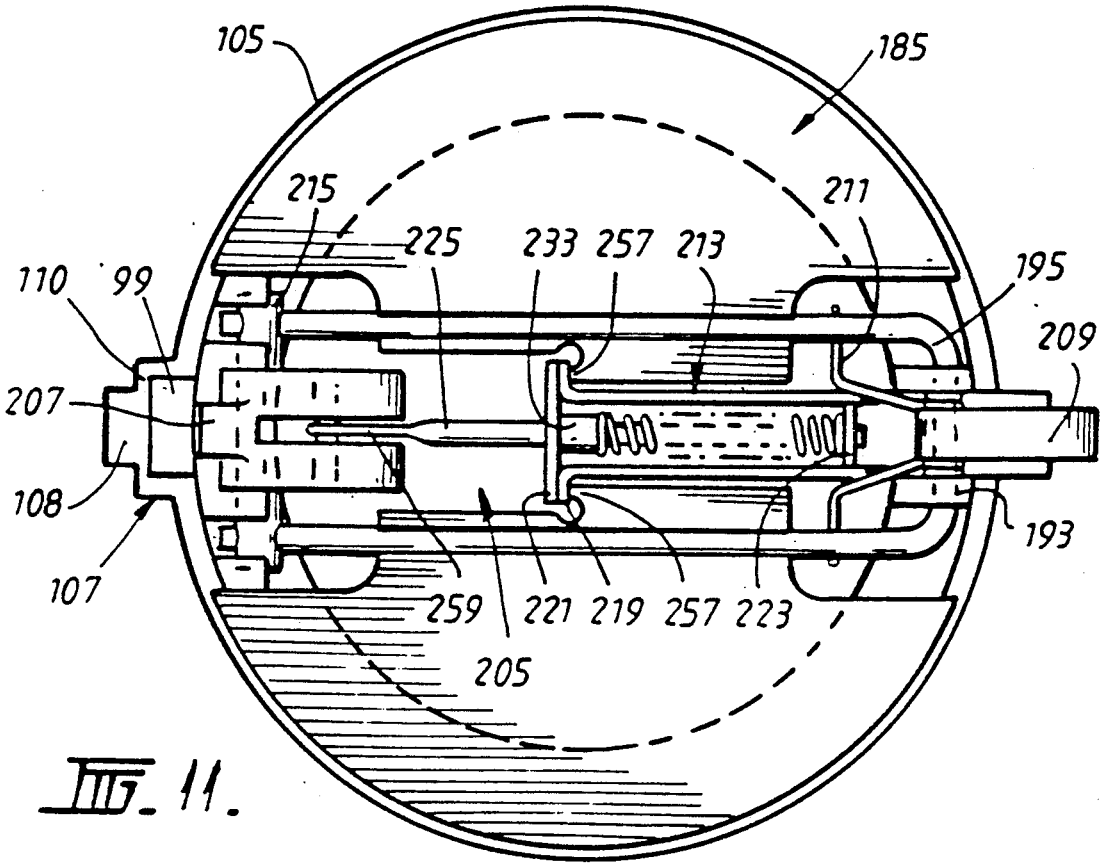
FIG. 11 is an underneath view of the flare showing the safety latch mechanism after a safety pin and the priming plug have been removed i.e. an underneath view relative to FIG. 8.
Figure 12:
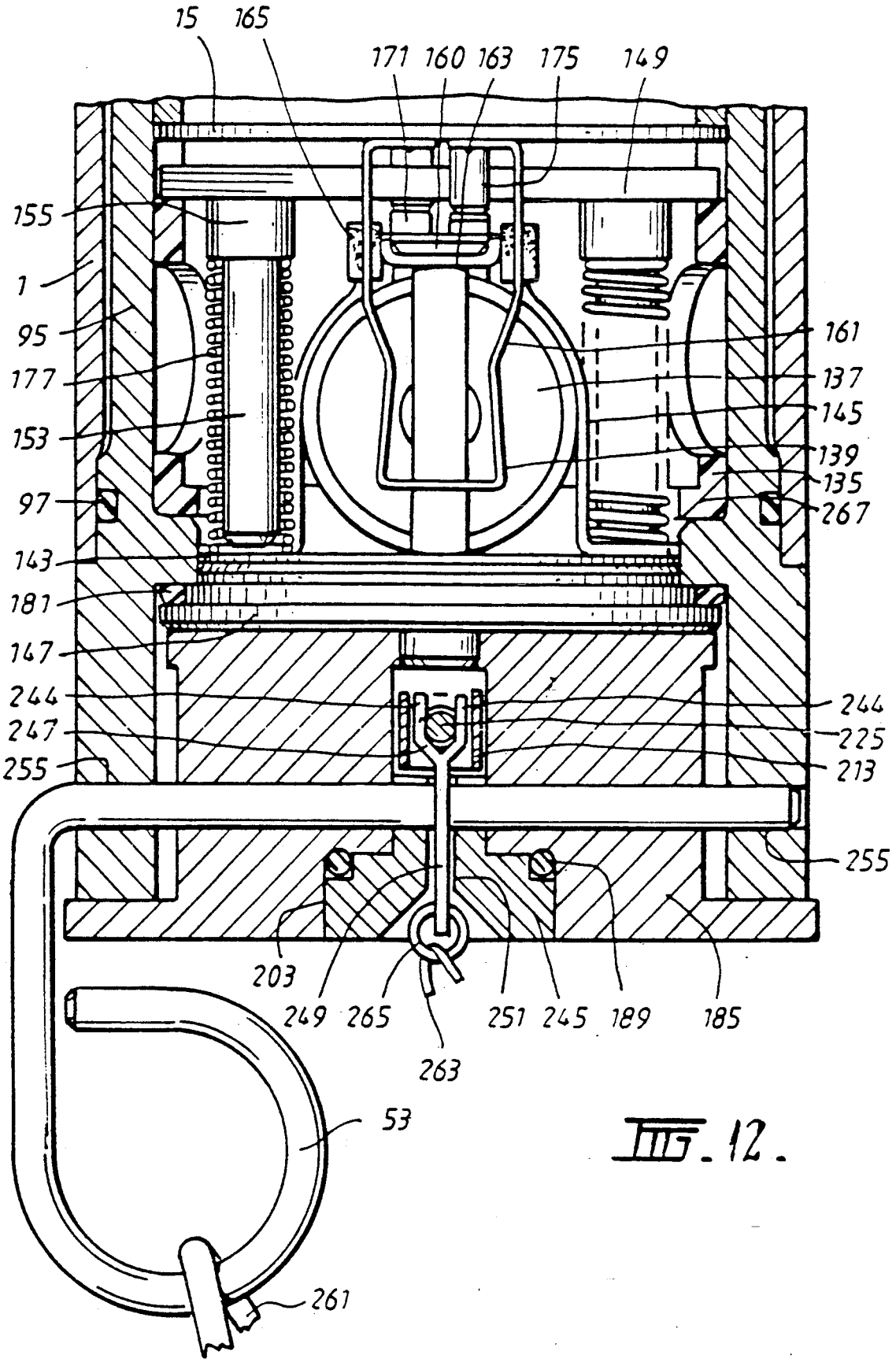
FIG. 12 is a side cross-sectional view of the flare showing a safety pin and part of the hydrostatic valve and battery compartment.
Figure 13:
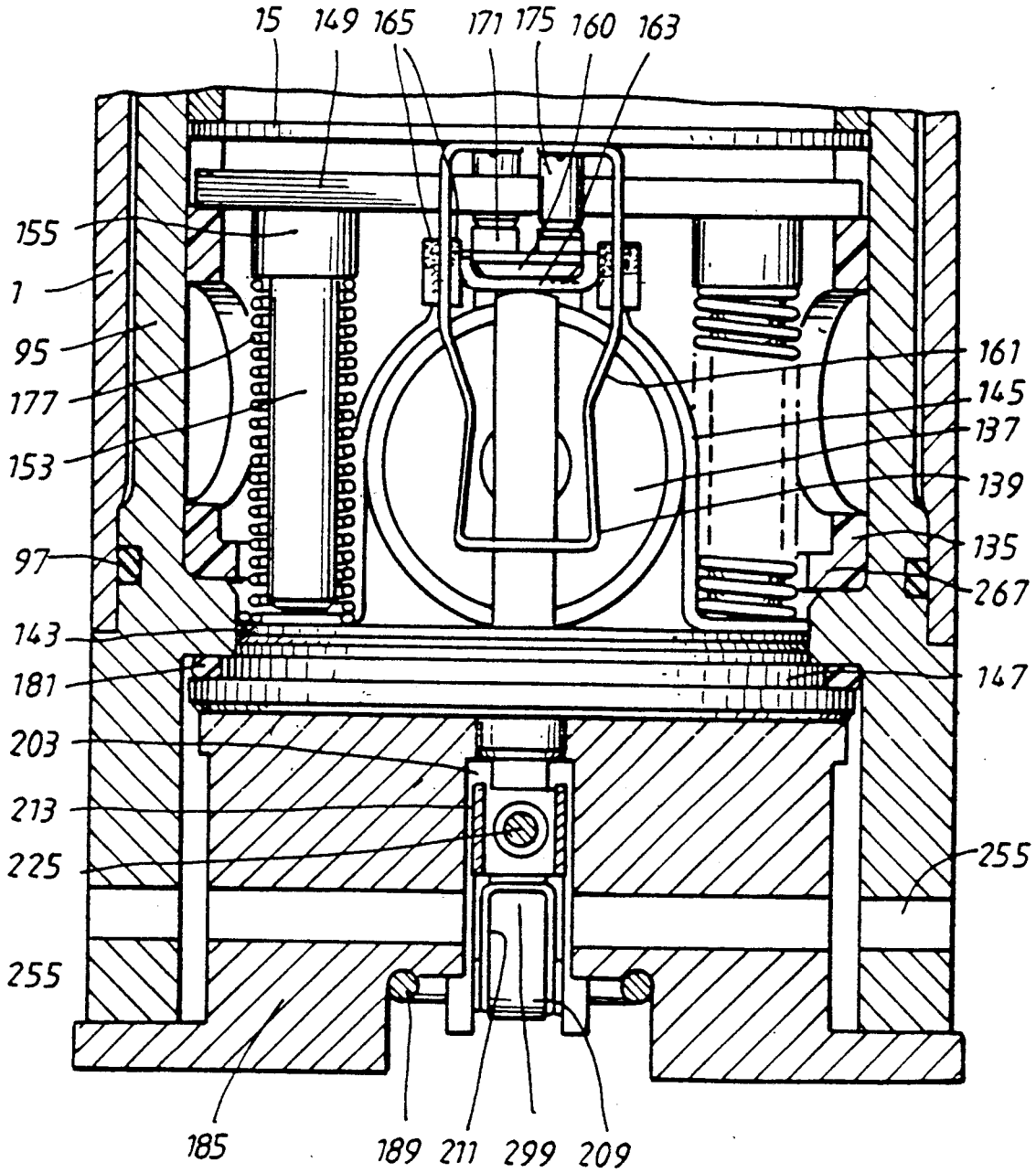
FIG. 13 is a view similar to that of FIG. 12 but wherein the safety pin and the priming plug have been removed.
Figure 14:
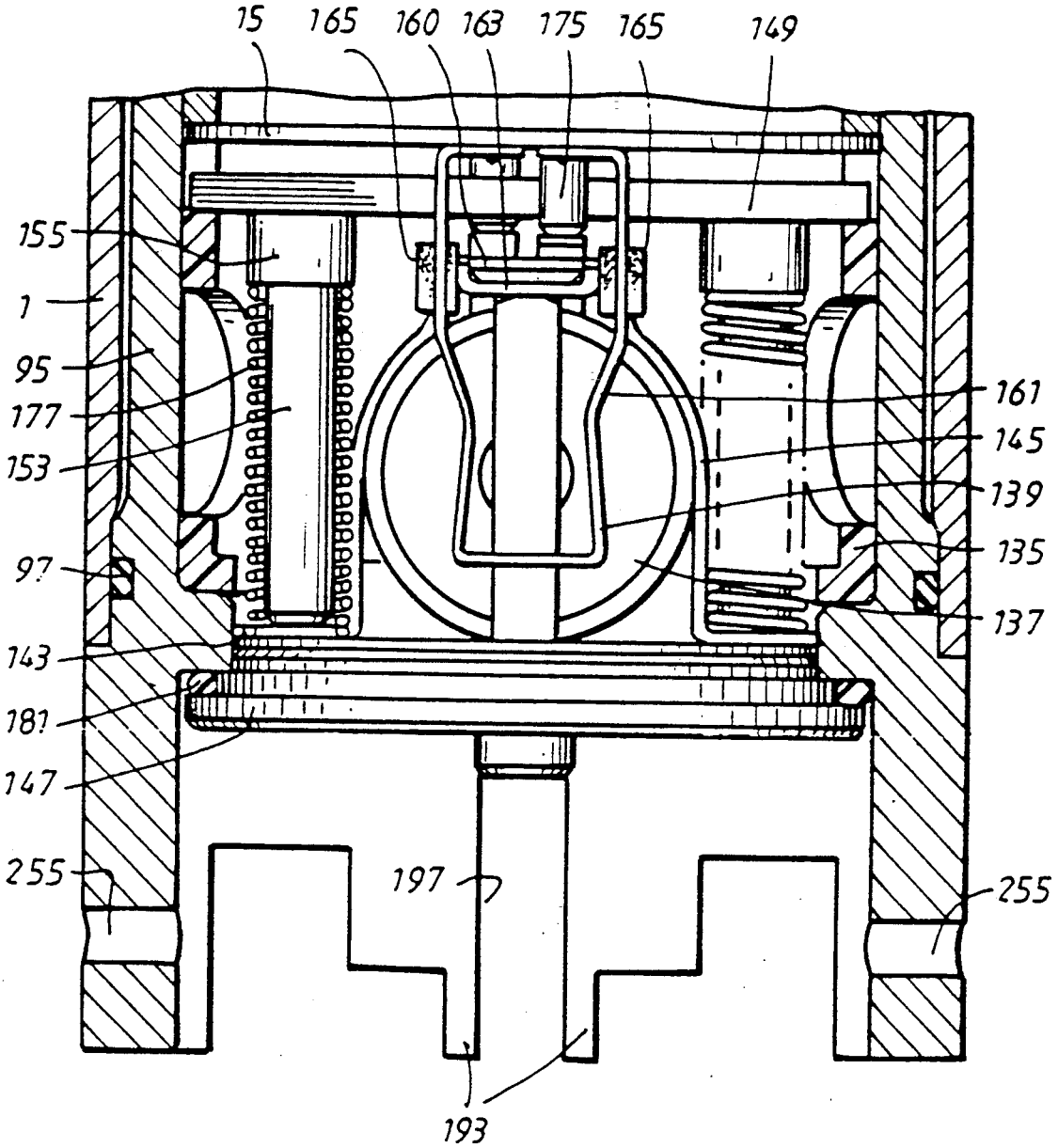
FIG. 14 is a view similar to FIG. 13 but showing the hydrostatic valve ready for activation.
Figure 15:
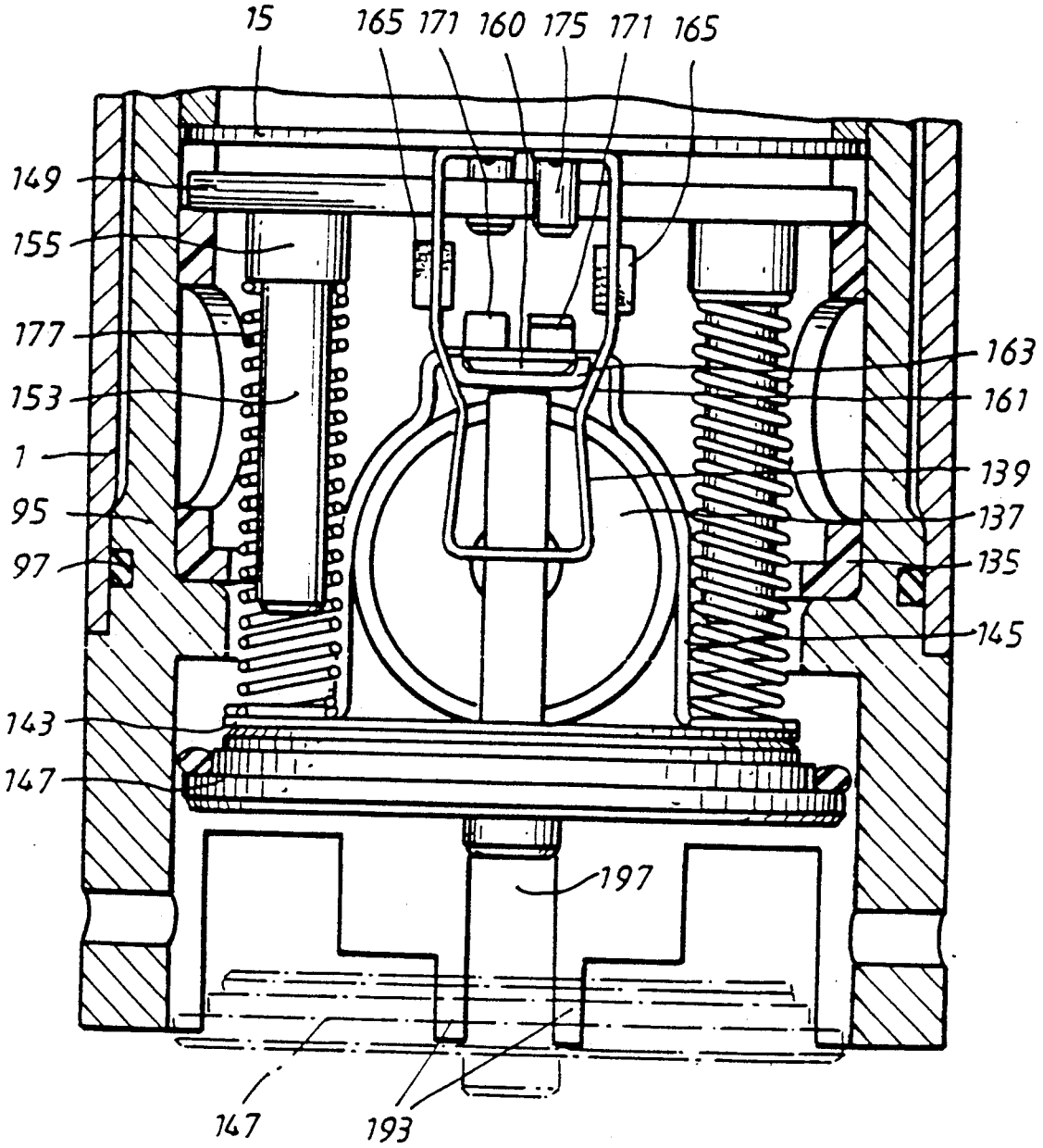
FIG. 15 is a view similar to that of FIG. 14 but showing the hydrostatic valve following activation.

The latch mechanism 51, when operated, permits release of a hydrostatic valve so it can be placed in a condition where it can be opened when the flare casing is at or near the surface of the water. In FIGS. 10 and 11 respectively the firing tube is shown generally as numeral 105. The firing tube 105 and the double keyway 107 are also shown in FIG. 8 and 9 and 16 and 17. Here the radially outer keyway 108 of the double keyway 107 stops short of the discharge end of the firing tube 105 so that the latch mechanism 51 can butt against an end 109 (see FIG. 17) of the keyway 107 and permit the hydrostatic valve to be placed in a condition where it can open when the flare casing is at or near the surface of the water. This will all be described in greater detail in due course. The bore riding bolt 99 can continue to follow the radially inner keyway 110 of the double keyway 107.

It is noted that the pay load 49 is angularly located relative to the tube 95 by a locating pin 111 (see FIG. 5). The locating pin 111 fits within an aperture within an end face of the end 79 and within an aperture in the end face of the tube 95. The pay load 49 is therefore angularly located relative to the tube 95. If FIG. 5 is observed, it can be seen that there are a plurality of apertures 113 provided in an end cap 115 of a chamber 117 in which the propulsion medium 85 is held. The apertures 113 are equally spaced in a circumferential direction around cap 115. The chamber 117 is, in turn, provided by a metallic cup-shaped member 119 which is fitted into the tube 95. Typically, the cup-shaped member 119 is made of aluminium. Typically, the end cap 115 is made from mild steel. Some of the apertures 113 are arranged to align approximately with each of the time delay means 87 so that when the propulsion medium 85 is ignited, heat can pass through the apertures 113 and ignite a fuse medium 121 within the time delay means 87. If the end cap 115 were not provided then propulsion medium 85 would not provide sufficient pressure to eject the payload 49 to the required height and also may not ignite the time delay means 87 so that, in fact, the flare composition 5 may then not be ignited. The end cap 115 is held captive within the member 119 by a metallic circlip 123. The cup-shaped member 119 is held relative to the tube 95 by a circlip 125 and by a locating pin 127.

The propulsion medium 85 typically comprises gunpowder, nitrocellulose, or nitrocellulose/nitroglycerine based propellants. The propulsion medium 85 is ignited by two match head igniters 129 which are known electric ignition devices. The two igniters 129 are electrically connected in series and the leads thereof passed through a grommet 131. A control circuit therefor is provided on the printed circuit boards 15 within the electrical circuit zone 91. The electrical circuit will be described in detail in due course.

The inclination detecting means 11 in the form of the mercury switch 13 is shown, in FIG. 5, with the same reference numerals as previously provided. It can be seen that the circuit boards 15 are supported relative to the tube 95 by the lowermost circuit board 15 being sandwiched between an inner tubular insert 133, as of plastics material and an opened bottom cup-shaped insert 135, as of plastics material. Insert 133 and insert 135 are both push fitted within the tube 95. The insert 103 of the bore riding bolt 99 locates in a U-shaped cut-out 136 (not clearly shown) in a side wall of the insert 133 to locate the insert 133 within the tube 95.

Electrical power for the electric circuit conducts from salt water batteries 137 through contacts 139 to circuit paths printed onto the board 15. The detail of salt water batteries 137 and the electrical conducting paths through the contacts 139 will be explained in due course. It should be noted that the lower circuit board 15 and components are coated with a waterproof insulating material thus ensuring that the circuit will still operate when area 141 is flooded with sea water.

Figure 6:
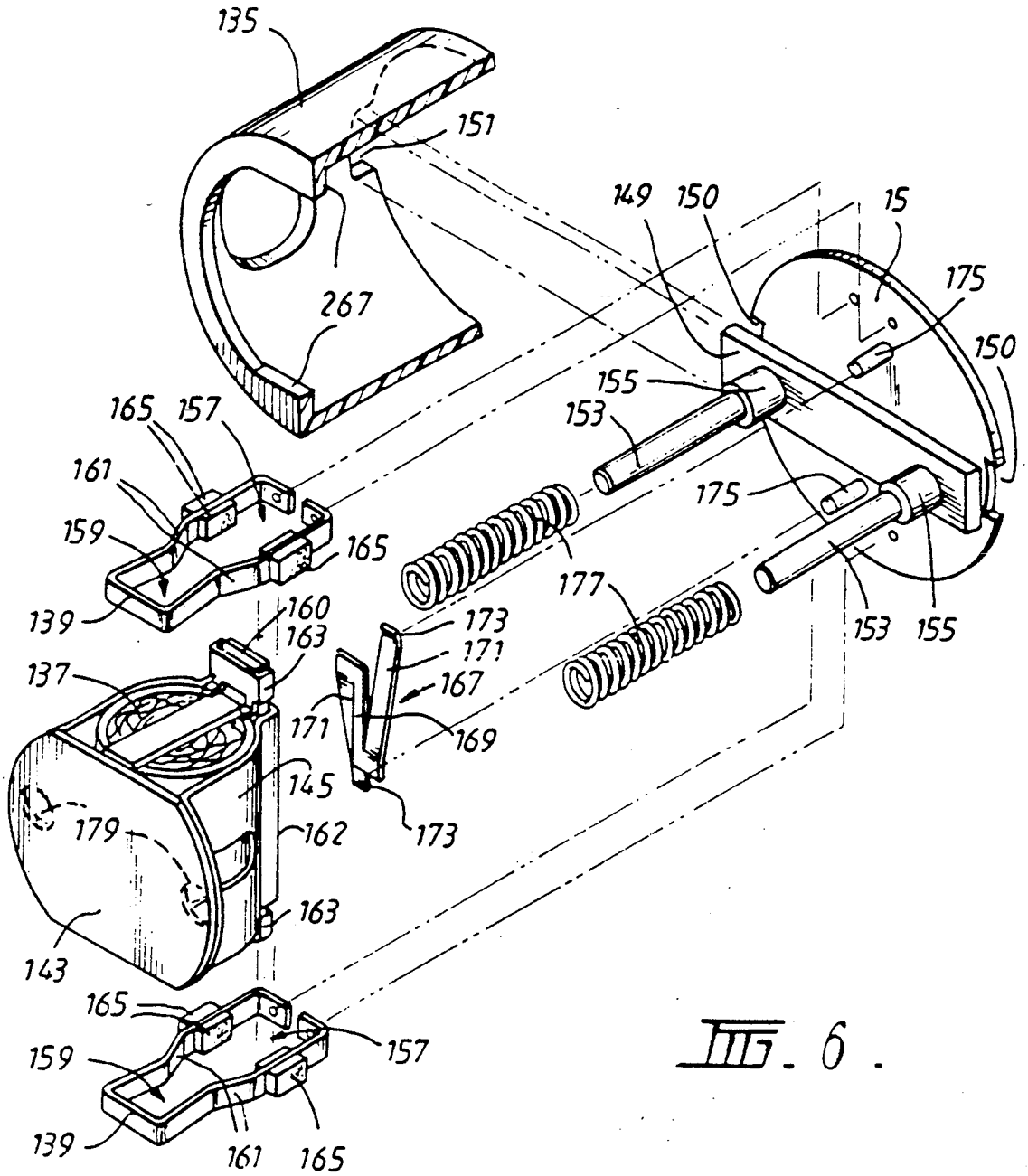
FIG. 6 is an exploded sectional view of a a salt water battery section of the flare shown in FIG. 2.

Referring now to FIG. 6 there is shown an exploded perspective view of the lowermost circuit board 15 and the salt water batteries 137 and associated components. The salt water batteries 137 are of known construction and typically of a type provided by E.S.B. Incorporated, U.S.A under code no. MK72. The salt water batteries are held within a plate 143 and a cover 145. The plate 143 is, in turn, arranged to located against the bottom of a hydrostatic valve 147 so that when the hydrostatic valve 147 opens, the salt water batteries 137 can move longitudinally within the casing 1 in a direction away from the lower circuit board 15 towards the lowermost end of the casing 1. Salt water can then be admitted into the cup-shaped insert 135 which provides a housing for the salt water batteries 137. The detail of how the hydrostatic valve 147 operates will be explained in due course. A pair of diametrically opposed cut-outs 151 (only one of which is shown in FIG. 6) is provided in the cup-shaped insert 135 and the outer ends of a bar 149 locate in the cut-outs 151. The insert 133 has a complementary pair of lugs (not shown) which partly enter the cut-outs 151 and hold the bar 149 in position. The lugs pass through further cut-outs 150 in the circuit board 15. The bar 149 has a pair of rods 153 fastened thereto which have enlarged head ends 155 to enable positive seating relative to the bar 149. Typically, the head ends 155 can be secured to the bar 149 as by swaging or other known fastening techniques.

The circuit board 15 carries a pair of strip contacts 139 of generally rectangular shape. The contacts 139 are riveted to the lower circuit board 15 and arranged to respectively carry positive and negative voltage to the circuit on the circuit boards 15. The contacts 139 have an enlarged portion 157 and a smaller portion 159. The smaller portion 159 has its sides slightly outwardly inclined relative to the enlarged portion 157 so that there are a pair of knees 161 in the smaller portion 159. The salt water batteries 137 have a pair of opposed electrical terminals 163 mounted at the side edges of the batteries 137 on an electrically insulating circuit board 160 which extends under a recess portion 162 formed in the top of the cover 145. Insulating bushes 165 are provided on the enlarged portion 157 so that when the hydrostatic valve 147 is in the closed position, the contacts 163 locate relative to the insulators 165 and electrical connection cannot be made between the terminals 163 and the contacts 139. Thus, until the hydrostatic valve 147 is released, the salt water batteries 137 are electrically isolated from the circuit on the circuit boards 15. When the hydrostatic valve 147 opens, as will be discussed in due course, the salt water batteries 137 are caused to move so that the contacts 163, in turn, move from being located on the insulators 165 in the enlarged portion 157, into the smaller portion 159 behind the knees 161. The dimensioning across the arms of the smaller portion 159 is such that good electrical contact is made between the contact 163 and the contacts 139. Thus, when the salt water batteries 137 are brought up to power, it can be transferred through the contacts 163 to the contacts 139 and then to the circuits mounted on the boards 15.

In order to ensure that voltage cannot be supplied to the igniters 129 if there is a leak which allows salt water to be applied to the salt water batteries 137 if the hydrostatic valve 147 has not operated, then a spring biased shorting member 167 is provided which shorts the igniter 129. As shown in FIG. 6 the spring biased shorting member 167 is of generally Z-shaped configuration. The shorting member 167 thus has a central portion 169 with two arms 171 which are bent out of the plane of the central portion 169 as shown. Free ends 173 of the arms 171 locate relative to pin contacts 175 riveted to the lower circuit board 15. The pins 175 have a circuit path on the circuit board which connects to the igniters 129. The shorting member 167 is mounted to the cover 145 of the salt water batteries 137 by the central portion 169 fitting within a recess (not shown) in the top of the cover 145. The recess is lined with electrical insulating material so that the shorting member 167 will be electrically isolated from the cover 145. Thus, the shorting member 167 is carried by the cover 145. When the hydrostatic valve 147 is closed the shorting member 167 shorts the igniters 129 but when the hydrostatic valve 147 is open the shorting member 167 is displaced from contacts 175 and the igniters 129 are no longer shorted. Thus, when the hydrostatic valve 147 is closed the shorting member 167 bridges the pair of contacts 175 and short circuits any voltage which may be developed by the salt water batteries 137. Accordingly, in this condition the circuit cannot be activated. It is only when the hydrostatic valve 147 opens that the salt water batteries 137 move into a position where the spring biased shorting member 167 no longer bridges the contacts 175, that power can be generated and delivered through the contact 139 to the circuit. The shorting member 167 also minimizes the likelihood of R.F. signals inducing voltage into the igniters 129 and causing unwanted ignition.

Springs in the form of compression springs 177 are arranged to locate over both of the rods 153 and to engage with areas 179 on the cover 145 of the salt water batteries 137. Accordingly, when the hydrostatic valve 147 is released, the springs 177 push the cover 145 and thus the salt water batteries 137, into a position where the contacts 163 thereof make contact with contacts 139.

By observing FIG. 5 it can be seen that the hydrostatic valve 147 is water sealed relative to the tube 95 by an "O" ring 181. The hydrostatic valve 147 is a cylindrical disc as of aluminium. It has a series of stepped portions 183 to enable it to appropriately locate within the tube 95 and to positively retain the "O" ring 181 thereto. When the flare casing 1 reaches a position at or near the surface of the water — typically 5 meters — then the water pressure acting on the undersurface of the hydrostatic valve 147 will be less than the air pressure within the tube 95 coupled with the forces provided by the springs 177 and thus the hydrostatic valve 147 will open. It should be observed that when the hydrostatic valve 147 opens, the salt water batteries 137 will be displaced in a direction longitudinally outwardly of the interior of the cup-shaped insert 135. Thus, if the hydrostatic valve 147 should open near the surface of the water as the flare casing 1 is still travelling upwardly toward the surface, then the salt water batteries 137 will be at a lowermost end of the flare casing 1 and in a position where there will be substantial turbulence of water. Thus, this ensures that there will be good wetting of the surfaces of the salt water batteries 137.

Figure 7:
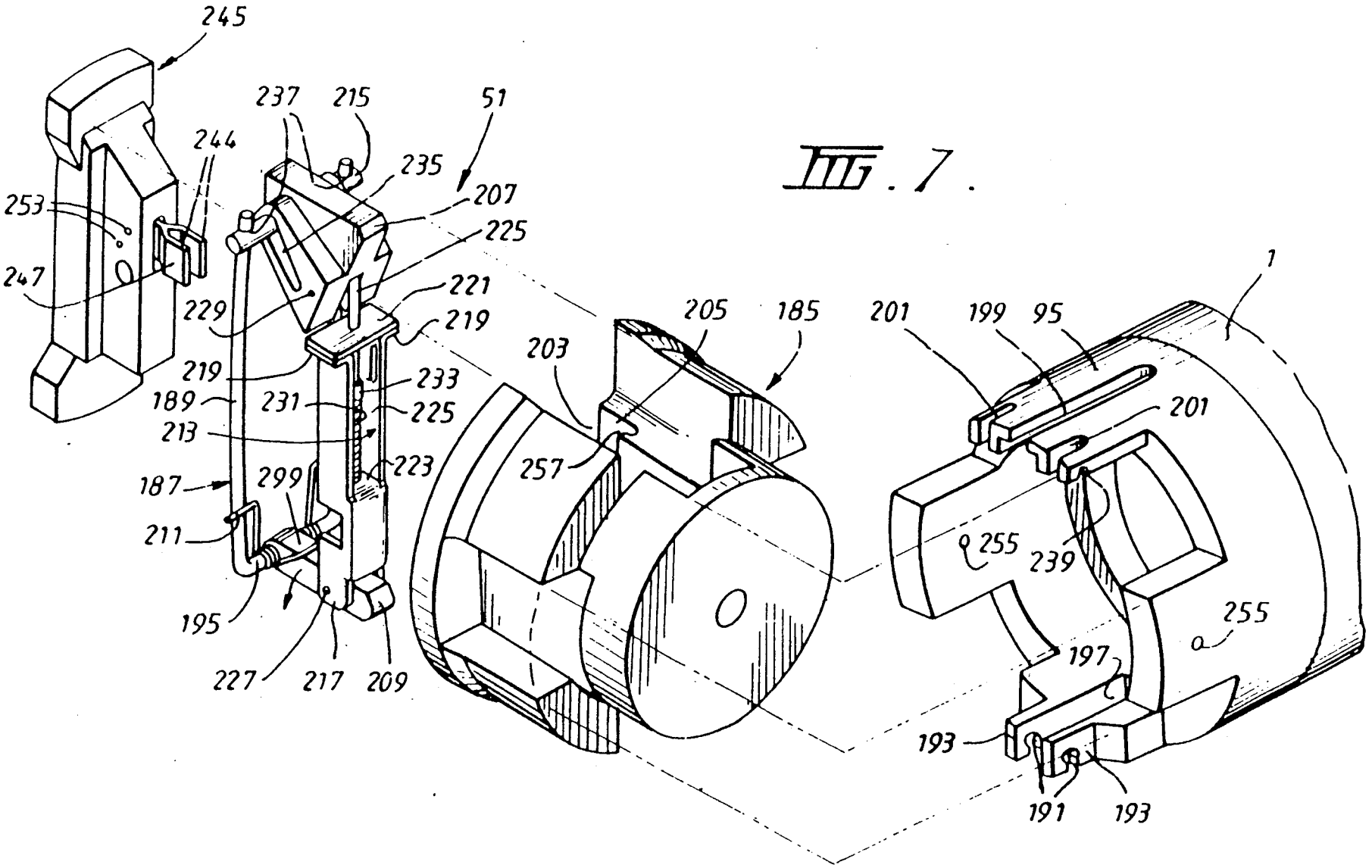
FIG. 7 is an exploded, part perspective view of the bottom end of the flare shown in FIG. 2.

Referring now to FIG. 7 there is shown an exploded diagrammatic end view of the latch mechanism 51. Reference should also be made to FIGS. 8 through 18 for an understanding of the latch mechanism 51.

By observing FIG. 7 it can be seen that a bottom end of the tube 95 has a somewhat complicated end configuration. The complicated configuration is provided to allow nested axially aligned seating arrangement of a tail plug 185. The tail plug 185 is used to press on the undersurface of the hydrostatic valve 147 to hold it in a closed position. The plug 185 is held captive to the tube 95 by means of the latch mechanism 51.

The latch mechanism 51 includes a U-shaped spring member 187 as of stainless wire. The resiliency of the arms 189 thereof is arranged so that forces will be applied by the arms 189 to the undersurface of the plug 185 to hold it in the position where the hydrostatic valve 147 is closed. The U-shaped spring member 187 is held within cut-outs 191 provided on two arms 193 at the tail end of tube 95 by the bridging portion 195 of the U-shaped spring member 187 locating therein. The two arms 189 are respectively on each side of an elongate slot 197. Diametrically opposite slot 197, is a further elongate slot 199 and a pair of smaller slots 201 which are respectively spaced one on each side of slot 199. The shape of the plug 185 is complementary to the shape of the tail end of the tube 95 so that when the plug 95 is fitted in the tail end 95 the plug 185 will be inhibited from angular rotation. The latch mechanism 51 locates within a transverse groove 203 at the bottom of the plug 185 and so that the arms 189 abut against the undersurfaces 205 (see FIG. 10) of the plug 185 on each side of the transverse groove 203.

The latch mechanism 51 has a primary latch 207 and a secondary latch 209. The primary latch 207 is used during firing of the flare casing 1 from the submarine vessel to trip and release the hydrostatic valve 147 so that it can open when it is at or near the surface of the water. The secondary latch 209 is a safety latch used to inhibit the tripping of the primary latch 207 until the secondary latch 209 is depressed or held inwardly relative to the side walls of the flare casing 1. The secondary latch 209 is fitted to the bridging portion 195 of the U-shaped spring member 187 so that it can swing within slot 197. Spring biasing means 211 in the form of a torsion spring is fitted about the bridging portion 195 so that it cooperates with the arms 189 and the side surface 299 of the secondary latch 209. This relatively biases the secondary latch 209 about the bridging portion 195 in a direction clockwise as shown in FIG. 7. Thus, the secondary latch 209 is biased outwardly of the side walls of the flare casing 1 as more clearly shown in FIG. 9. Because the U-shaped spring member 187 is retained in the cut-out 191, the latch mechanism 51 is supported relative to the arms 193 and thus there is relative motion of the secondary latch 209 to an outwardly direction position as shown in FIG. 9 when the latch mechanism 51 is holding the plug 185 to the bottom of the flare casing 1.

The primary latch 207 is supported jointly by a spring carriage assembly 213 and by a rod 215. The spring carriage assembly 213 is a generally rectangular elongate member formed from sheet metal. The spring carriage assembly 213 has a pair of arms 217 at one end and a transversely extending pair of arms 219 at the other end. A plate 221 is spot welded to the arms 219. A lug 223 is provided on the spring carriage assembly 213 intermediate the two arms 217 and 219. The spring carriage assembly 213 therefore has a rectangular shaped space 225 between the lug 223 and the plate 221. An aluminium alloy rod 225 is arranged to pass longitudinally of the spring carriage assembly 213 through the plate 221 and through the lug 223 in suitable apertures therein. The rod 225 is thus able to move inwardly and outwardly relative to the spring carriage assembly 213. The spring carriage assembly 213 is connected to the secondary latch 209 by a pin 227 which passes through the arms 217 and through the secondary latch 209. Thus, the spring carriage assembly 213 is able to swing relative to the secondary latch 209. The rod 225 is, in turn, held to the primary latch 207 by a pin 229 so that the rod 225 can swing relative to the primary latch 207. Spring means 231 in the form of a compression spring is provided on the rod 225 in the space 226. The spring means 231 engages with the lug 223 and with a sleeve 233 fitted on the rod 225 which is crimp fitted or by direct crimping of rod 225 or by other means over the rod 225. Thus the rod 225 will always be biased in a direction towards the primary latch 207. The sleeve 233 locates against the plate 221 to provide a limit for the outward extension of the rod 225.

The rod 215 passes through an elongate slot 235 in the primary latch 207. The rod 215 is provided with a hole 237 at each end. The holes 237 extend transversely to the longitudinal axis of the rod 215. The holes 237 are of sufficient diameter to receive the arms 189 of the U-shaped spring member 187 and to permit the rod 215 to slide longitudinally of the arms 189. The rod 215 is, in turn, held within an elongate slot 235 in the primary latch 207.

Figure 16:
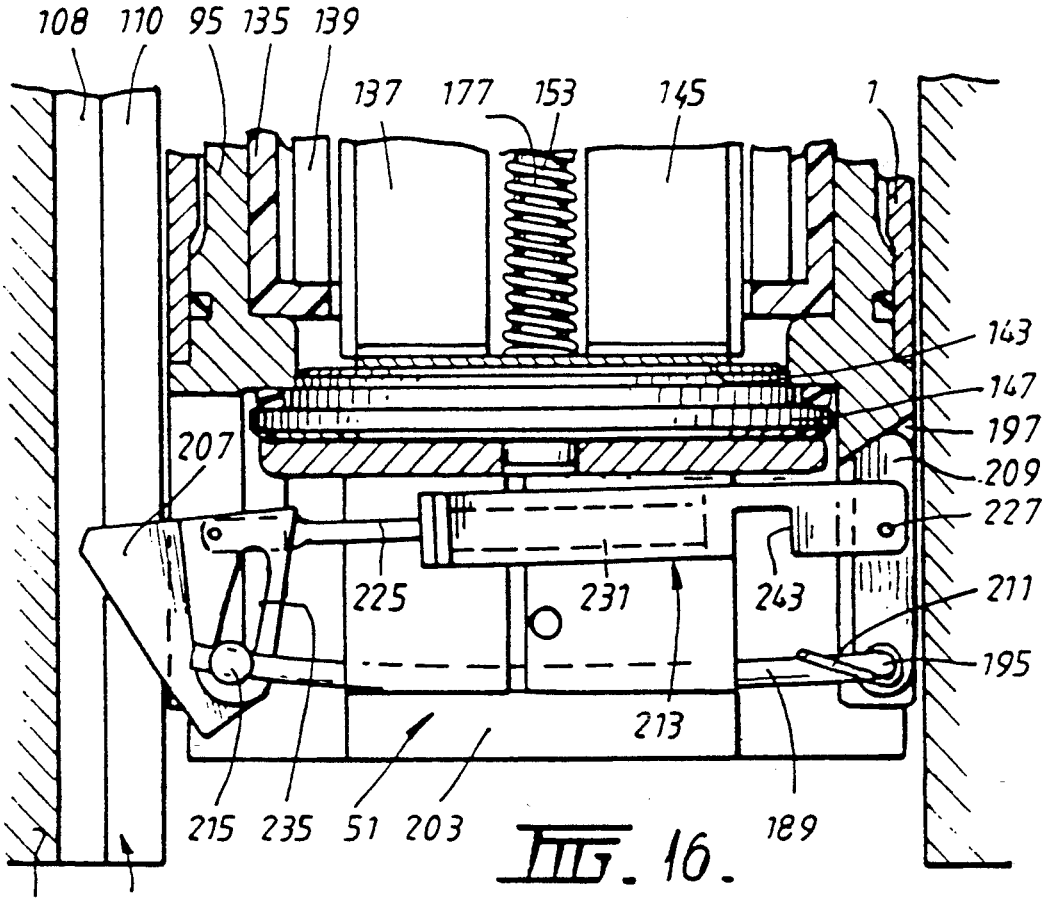
FIGS. 16, 17 and 18 are side sectional views showing release of the safety latch mechanism.
Figure 17:
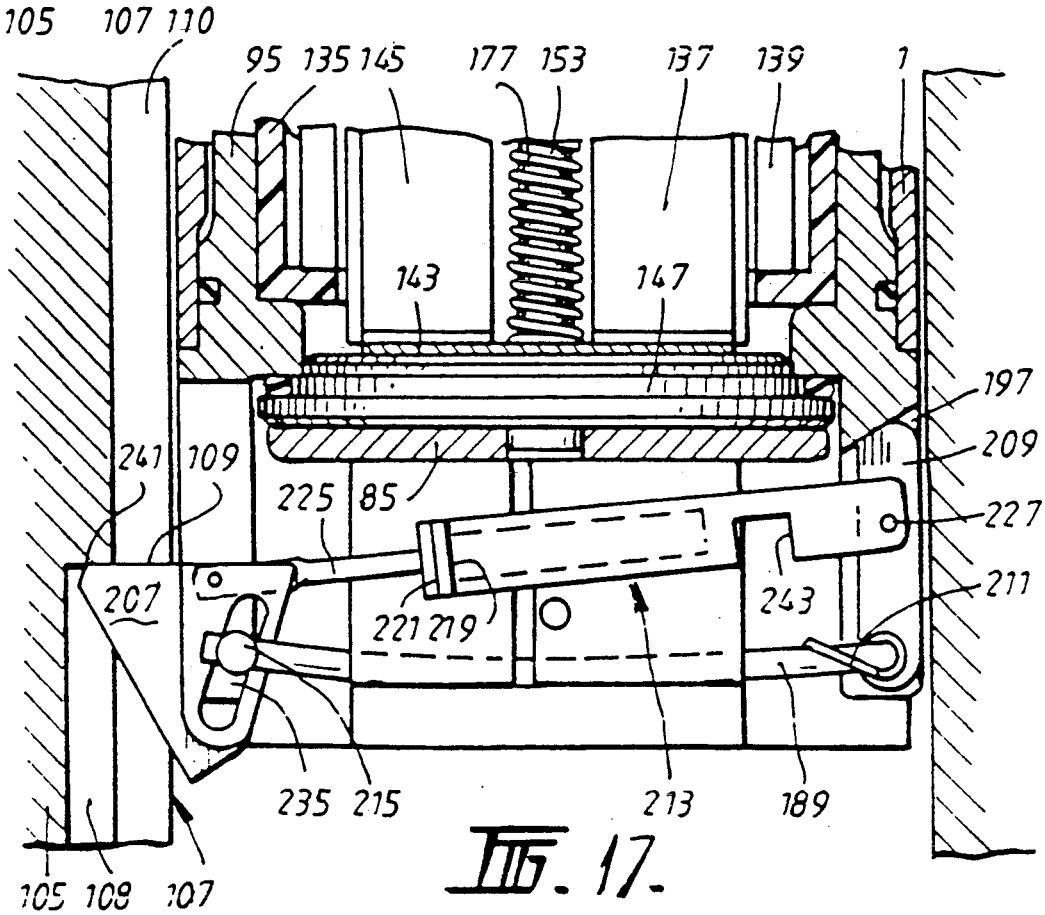
Figure 18:
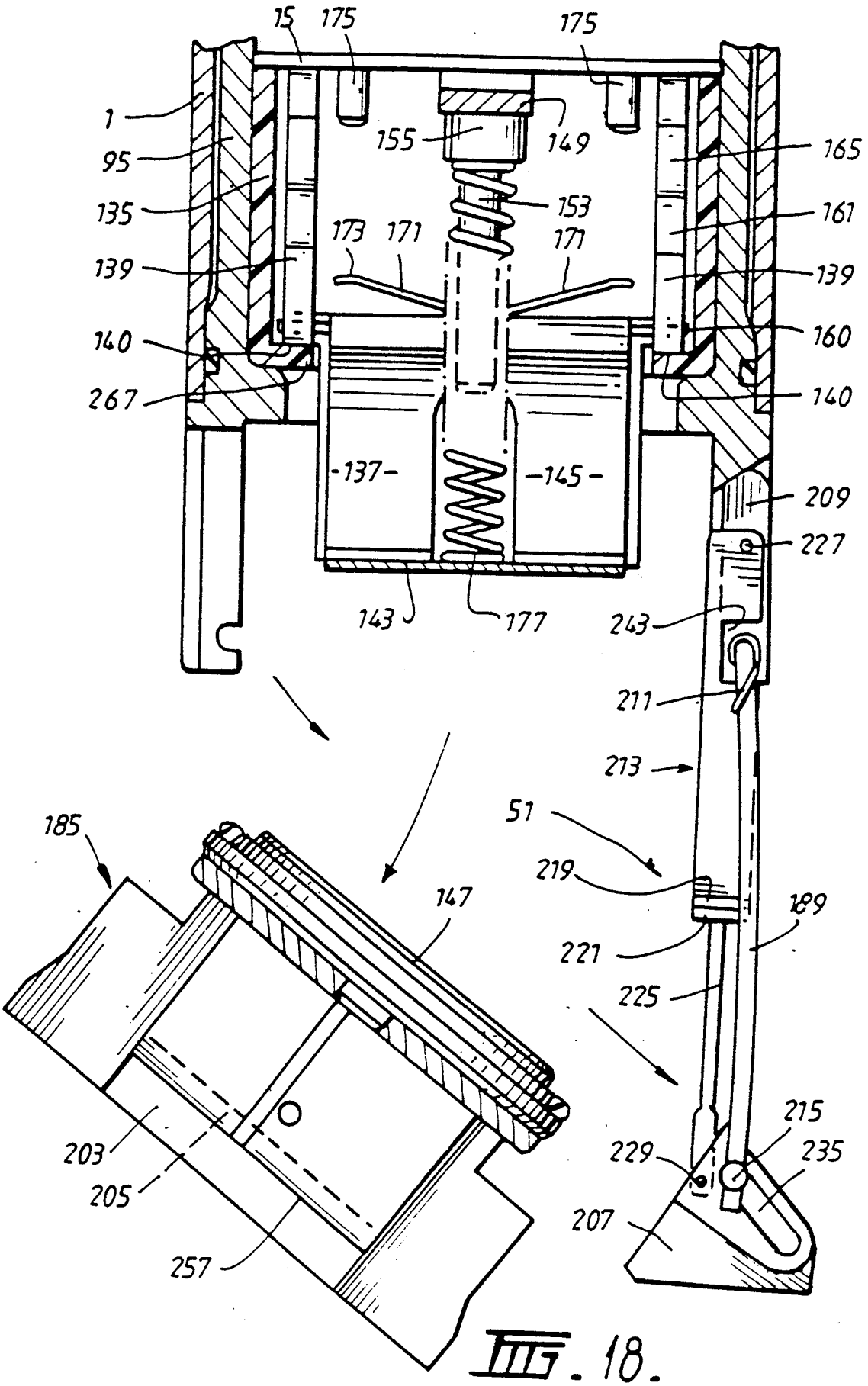

The latch member 51 is located in the cut-outs 191 on the arms 193 and so that the rod 215 locates in shallow depressions 239 which are formed on the radially inner surfaces of the tube 95 on each side of slot 199. This is shown in FIG. 8 and FIG. 18. FIGS. 8, 16 and 17 show that the arms 189 are curved somewhat, thereby applying a spring force to the undersurface of the plug 185 and urging the hydrostatic valve 147 to a closed position.

By referring, now specifically, to FIGS. 16, 17 and 18 it can be seen how the latch mechanism 51 operates. FIG. 16 shows the latch mechanism 51 in an operative position in the firing tube 105 and ready for firing. It can be seen that the secondary latch 209 has moved inwardly of the flare casing 1 and held therein by the side walls of the firing tube 105. In this condition the primary latch 207 is urged to extend outwardly of the flare casing 1 in the radially outer keyway 108 in the double keyway 107 in the firing tube 105. Because the secondary latch 209 has moved inwardly of the external surfaces of the flare casing 1 the spring carriage assembly 213 applies a force through rod 225 as determined by the biasing force applied from the spring means 231 to cause the primary latch 207 to extend into the outer keyway 108. In this condition the primary latch 207 pivots at the lowermost end of the elongate slot 235.

FIG. 17 shows the flare casing 1 in a position where the flare casing 1 has risen to a position where the primary latch 207 is engaging with a shoulder 241 in the keyway 108. The flare casing 1 is able to continue upwardly within the firing tube 105 by the launching pressure provided by the expelling means used to release the flare casing 1. FIG. 17 shows that the rod 215 has moved slightly within the elongate slot 235 towards the end remote from where it was positioned in FIG. 16. This movement is caused by the primary latch 207 striking the shoulder 241 and causing the primary latch 207 to move in a direction generally longitudinally of the firing tube 105.

FIG. 18 shows the latch mechanism 51 in a released position and the plug 185 separated from the bottom end of the flare casing 1. It also shows that the hydrostatic valve 147 is able to move away with the plug 185. The spring carriage assembly 213 is provided with a cut-out 243 which permits the spring carriage assembly 213 to swing about pin 227 so that it extends generally parallel with the longitudinal axis of the flare casing 1. In this position, the bridging portion 195 of the U-shaped spring member 187 is received within the cut-outs 243.

It should be appreciated that the latch mechanism 51, comprising the primary latch 207 and the secondary latch 209, provide a security means for inhibiting accidental release of the hydrostatic valve 147. Accordingly, if the flare casing 1 is removed from the firing tube 105, the secondary latch 209 will be caused to extend radially outwardly of the circumferential surfaces of the flare casing 1 and hold the priming latch 207 in an inoperative trip position within slot 199 and also within the circumferential surfaces of the flare casing 1. The priming plug 245 should then be desirably reinserted to the flare casing 1 before the flare casing 1 is then again loaded into the firing tube 105. Secondary latch 209 and priming latch 207 are manually held within the circumferential surfaces of the flare casing 1 before the priming plug 245 is reinserted.

In an unprimed condition for firing the flare casing 1 has the secondary latch 209 retained radially inwardly of the circumferential surfaces thereof. This is achieved by the use of a priming plug 245 which fits into the plug 185 and co-operates with the latch mechanism 51. The priming plug 245 contains a Y-shaped metallic member 247. The Y-shaped member 247 is located with its trunk 249 fitted within an elongate slot 251 in the priming plug 245. A pair of pins 253 loosely secure the Y-shaped metallic member 247 to the priming plug 245 by passing through the trunk 249. This mounting arrangement of the Y-shaped metallic member 247 relative to the priming plug 245 allows for minimal swinging displacement of the Y-shaped member relative to the priming plug 245. The priming plug 245 is generally elongate so that it can extend transversely across the bottom end of the plug 185, in the transverse groove 203 therein. (This is clearly shown in FIG. 12). A pair of arms 244 (see FIG. 12) of the Y-shaped metallic member 247, are arranged to locate with the rod 225 therebetween. In this condition, the sleeve 233 locates one pair of side faces of the Y-shaped metallic member 247. The other pair of side faces of the Y-shaped metallic member 247 locate on the inner surface of plate 221 and thus holds the primary latch 207 and the secondary latch 209 radially inwardly of the circumferential surfaces of the flare casing 1. FIG. 10 shows this clearly. The priming plug 245 therefore extends transversely across the bottom end of the tube 95 and is arranged so that the bottom end of the tube 95 is flush, i.e. so that the outer surfaces of the priming plug 245 and the plug 185 at the end of the tube 85 are coplanar. The priming plug 245 is held retained to the bottom end of the tube 95 by a safety pin 53 which passes through a bore 255 which extends through the bottom end of the flare tube 95 through the plug 185 and through the priming plug 245. When the safety pin 53 is located, a positive pressure is applied by the co-acting surfaces of the safety pin 53 with the internal surfaces of the bore 255 to apply a positive pressure to the hydrostatic valve 147 independently of the forces applied by the arms 189 of the U-shaped spring member 187.

It should be observed that the radially outwardly extent of swinging of the secondary latch 209 is determined by the arms 219 of the spring carriage assembly 213 locating against shoulders 257 provided in the transverse groove 203.

It should also be observed that the rod 225 is flattened at the end which connects with the primary latch 207 and that the flattened end swings within a groove 259 provided in the primary latch 207.

Conveniently, the safety pin 53 is provided with a cord 261 (see FIG. 12) which can be easily grasped by a user to permit removal. Similarly, the priming plug 245 is provided with a cord 263 which passes through a ring 265 which, in turn, passes through the Y-shaped metallic member 247, to permit easy withdrawal by a user.

During normal or intended loading of the flare casing 1 within the firing tube 105, the safety pin 53 and priming plug 245 are in place and only then removed. The safety pin 53 is removed prior to fully inserting the flare casing within the firing tube 105 and the safety plug is removed following the full insertion.

The longitudinal extent of movement of the salt water batteries 137 is determined by terminals 163 locating against ends 140 of contacts 139 in association with shoulders 267 (see FIG. 18) of the cup-shaped insert 135.

Referring now to FIG. 19 there is shown an overview of the flare casing 1. It can be seen that the flare casing 1 is elongate and that it has a sensor 23 for sensing when the nose end is above water. A flare composition 5 is provided within the body of the flare casing 1. A propulsion medium 85 is provided at a position where it can expel the flare composition 5 from the flare casing 1 when it is ignited. Suitable igniters 129 are provided in the propulsion medium 85. The igniters 129 are shorted by a shorting member 167. The shorting member 167 is, in turn, operatively linked with a hydrostatic valve 145 so that when the hydrostatic valve 145 releases, the shorting member 167 will no longer be across the igniters 129. Simultaneously with the releasing of the hydrostatic valve 145, the salt water batteries 137 are immersed in salt water and also brought into contact with an electric circuit 269 which, in turn, provides a time delay before activation of the igniters 129. The time delay is provided to allow the salt water batteries to come up to power prior to activation of the electric circuit to sense the vertical attitude and/or nose above water condition as determined by the inclination means 11 and by the sensor 23.

When the igniters 129 are activated and the propulsion medium 85 ignited, then the consequential forces co-act with the bottom of the flare composition 5 and the push rods 29 and the push tube 63 to force the nose 25 from the flare casing 1 when sufficient pressure has been generated. Thus, the pay load 49 can be fired into the air with required speed and direction to reach a predetermined altitude or approximately so.

Figures 20, 21:
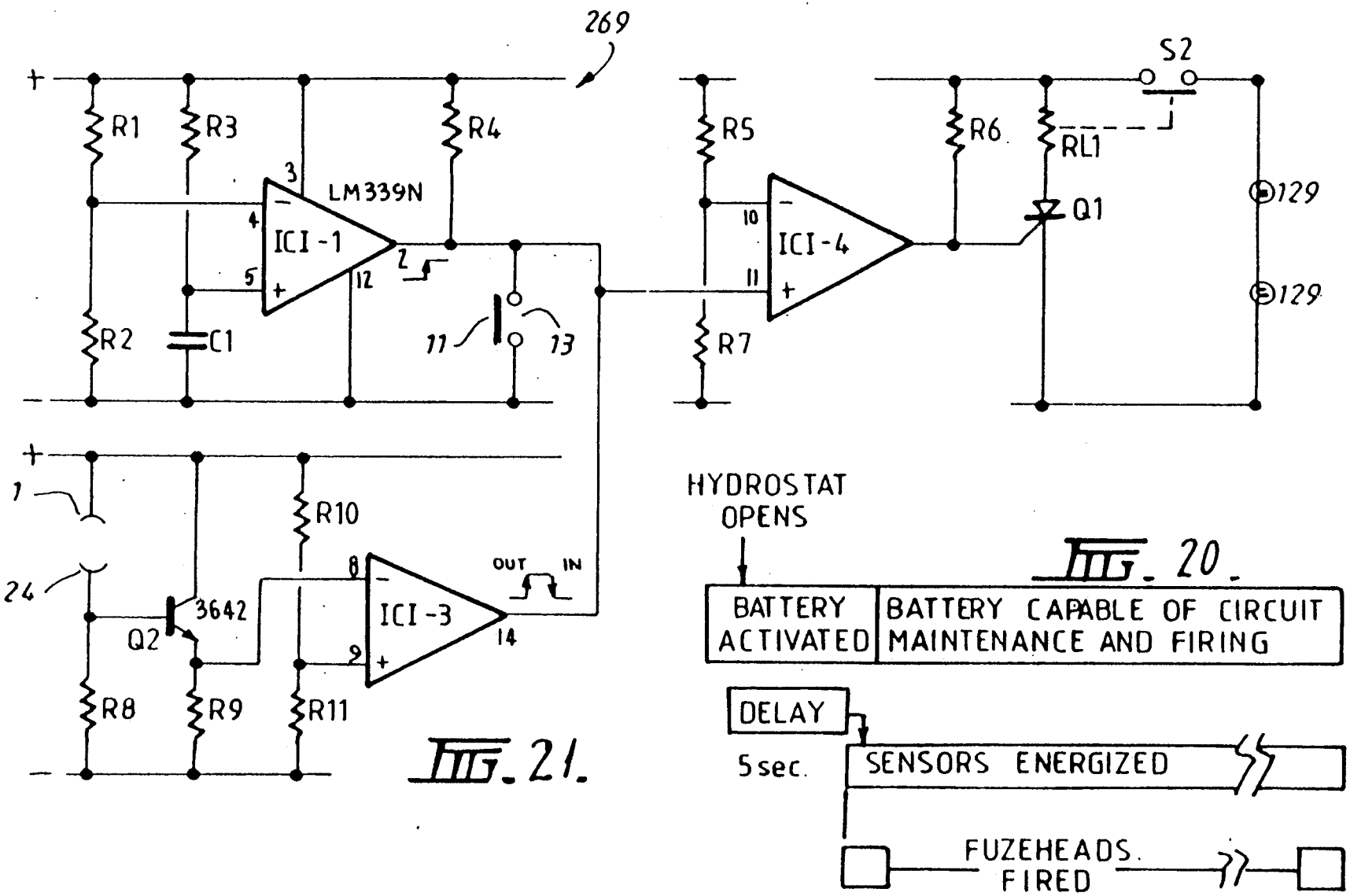
FIG. 20 is a timing diagram of the operation sequences of part of the cycle of the firing of the flare.
FIG. 21 is a block schematic diagram of the electronic components which form part of the control circuit of the flare.

FIG. 20 shows a timing diagram of operations. It can be seen that as the hydrostatic valve 147 opens, the batteries 137 will provide voltage almost instantaneously but in practice that voltage will not be the nominal voltage which can be supplied by those batteries. Accordingly, the circuit 269 has a delay of nominally 5 seconds to allow the batteries to come up to power. Following the delay, the sensors 23 and the inclination means 11 are activated. Thus, following the 5 second delay, if the flare casing 1 is in a vertical position and the nose 25 is above sea level, then the circuit will apply power to the igniters 129 to initiate firing of the pay load 49 into the air.

The salt water batteries 137 comprise a pair of sea water cells which can provide a supply potential within the range of 2.8 to 3.0 volts when suitably powered up. In order that the igniters 129 receive the full power from the salt water batteries 137, then the electric circuit 269 includes a coil actuated reed switch to be referred to later, which permits the full battery potential to be supplied directly to the igniters 129. The sensor ring 24 at the nose 25 of the flare casing 1 is arranged as a negative electrode which is 3 mm wide and 76.2 mm in diameter. The positive electrode comprises the aluminium casing of the flare casing 1. The two electrodes are separated by the plastics material from which the nose 25 is made so there is a 5 mm gap between the sensor ring 24 and the aluminium flare casing 1. When the two electrodes — sensor ring 24 and the flare casing 1 — are wetted in salt water by being immersed therein, a potential difference exists between the electrodes. The resulting current depends on the salt water concentration and the electrode wetted surface area. The arrangement is such that with 2.9 volts supplied from the salt water batteries 137, there is an immersion resistance of 70 ohms. Following removal from the salt sea water the resistance increases to greater than 300 ohms. An open circuit condition is not immediately achieved due to the residual film of salt sea water between the electrodes of the sensor 23 and the flare casing 1. The change in resistance from 70 ohms to 300 ohms is used to control a switching transistor (to be referred to later) which provides a 1.9 volt positive step output voltage from a nominal 2 volt power supply.

Referring now to FIG. 21 there is shown a detailed circuit diagram of the components used in the electric circuit 269. It can be seen that the sensor ring 24 and the aluminium flare casing 1 are connected respectively into the circuit 269. The inclination means 11 — the mercury switch 13 — is also interconnected into the circuit. When the hydrostatic valve 147 operates, the salt water batteries 137 are immersed in salt sea water and a voltage is applied to the positive and negative rails from the battery. The delay of five seconds is provided by components R1 — R3, C1 and one element of a four element IC — LM339N — IC1 — 1. After the delay period, an output is provided on pin 2 which is held low, thus ensuring that IC — 4 cannot operate. When IC1 — 4 operates, it provides an output signal to trigger Q1 to, in turn, operate the reed relay RL1 to, in turn, operate switch S2 to apply the rail voltage across the two igniters 129. The inclination means 11 is connected between pin 2 and the −Ve rail so that when the angular inclination of the flare casing 1 exceeds the tolerance limit of the inclination means 11, the output of IC1 — 3 is held low. IC — 4 is arranged to operate to trigger Q1 when IC1 — 3 output goes high — i.e. nose above water level.

In order to sense the nose 25 is above water level the resistance of the electrode 24 and flare casing 1 is low, thus biasing Q2 "on" and thus holding pin 14 low. As the nose 25 emerges from the water, the resistance between sensor 23 and the flare casing 1 increases and the base condition of Q2 — changes and it is switched off and the output of pin 14 goes high.

In order that the igniters 129 can have the rail voltage supplied thereto, the inclination means 11 must be closed and there must be an output signal on pin 14 of IC1 — 3. When this condition occurs, Q1 conducts and allows current to flow through RL1 which, in turn, closes S2 and full battery potential is applied to the igniters 129. A reed switch S2 is utilized as it has no potential drop when closed, and the coil of RL1 in combination with Q1 is such that the reed switch S2 will be held closed with a potential less that half of the closing potential. This in turn, maintains the switch S2 closed when the full battery potential is applied across the igniters 129 and causes the rail potential to drop somewhat.

Figure 22:
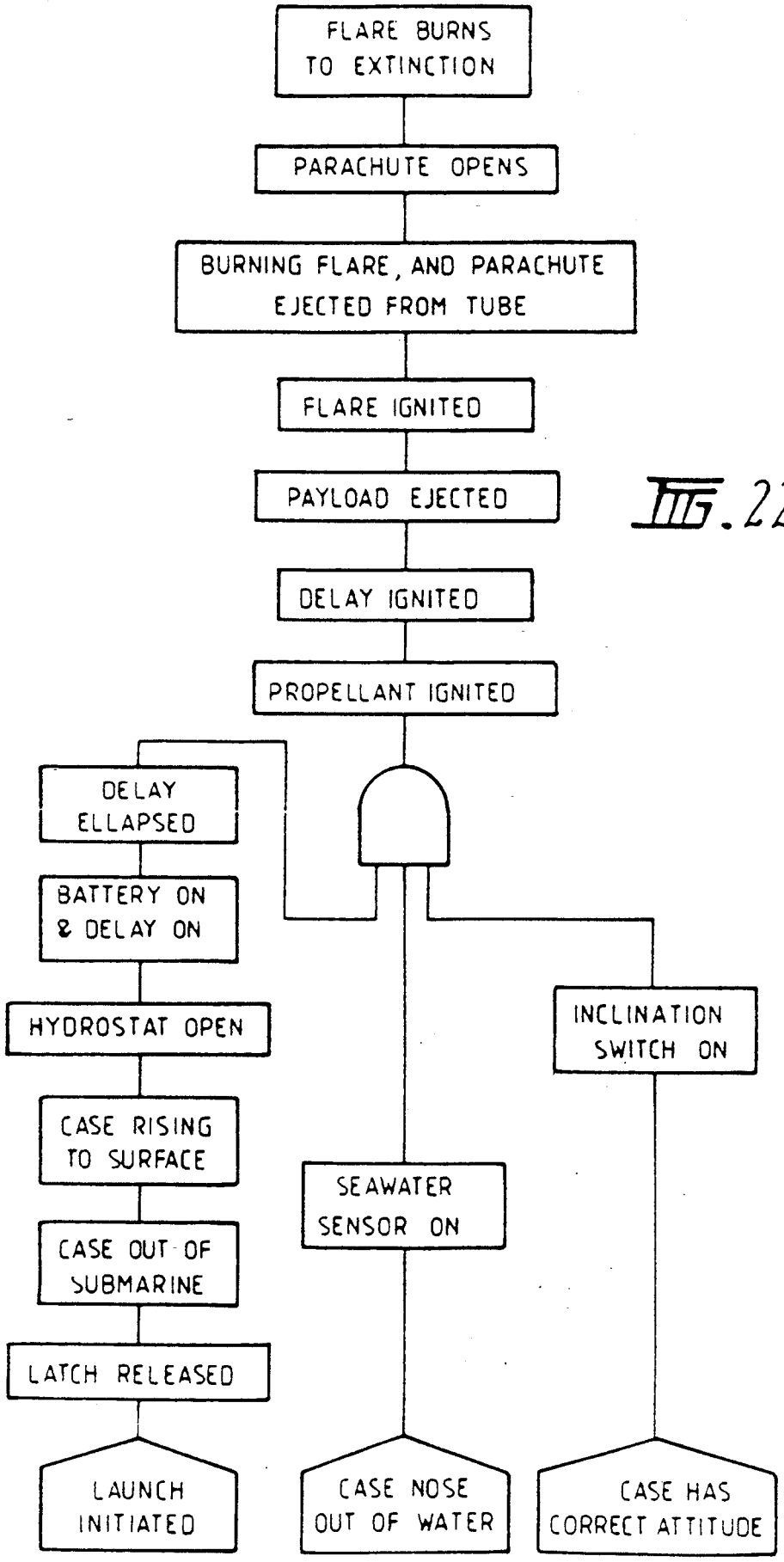
FIG. 22 is a flow diagram of the sequences of operation of the flare.

Referring now to FIG. 22 there is shown a sequencing diagram of events which occur during firing of the flare from a submarine location to the surface of the water and from the surface of the water into the air. The sequencing of events is self explanatory.

The dimensions of the flare casing 1 are approximately 1 meter in length and approximately 76 mm in diameter. The flare casing 1 is designed to withstand pressures at depths down to 650 meters where it must survive not only the normal environmental sea water pressure but also an extremely high pressure pulse which is generated by a water ram facility at the time of discharge of the flare casing 1 from the firing tube 105 in the submarine vessel. After the flare casing is released from the submarine it is no longer under the influence of the ejector system in the submarine and the velocity and stability of the flare casing 1 is then dependent on the physical configuration of the total package. The buoyancy is chosen such that the flare casing 1 will rise at a rate of approximately 3 meters per second for optimum performance. Typically the centre of gravity of the complete flare casing 1 is chosen to be longitudinally below the centre of buoyancy. In this way the flare casing 1 will rise to the surface of the water in a substantially upright manner. Moreover, such configuration will also permit the flare casing 1 to be substantially upright at the surface of the water if it is not subjected to waves and/or other external influences. Thus, the flare casing 1 will be such as to remain substantially upright when at the surface of the water and be substantially righting if it should be tilted from the normal perpendicular orientation.

Thus, the submarine flare is designed to meet the following objectives:

(a) The mechanical strength of the flare casing is sufficient to resist the hydrostatic pressure at the maximum working depth of 650 meters plus launch over pressures of approximately 3.7 MPa.

(b) The flare components are of minimum weight in order satisfy the requirement for maximum payload capacity consistent with an acceptable buoyancy force.

(c) The submarine flare configuration is compact and at the tail end of the case 1 to maximize the metacentric height to ensure an acceptable level of hydrodynamic stability during ascent.

(d) The flare configuration is designed so end of service life refurbishment can be economically feasible.

(e) The flare is such that it can be manufactured by production processes such as metal pressing, diecasting and plastic injection moulding.

(f) The flare is simple to operate and is such that it minimises potential for operator error in emergency situations.

(g) The flare can withstand the shock from being launched from a submarine vessel with both high and low discharge over pressures.

(h) It suits conventional firing tubes in submarine vessels such as U.S. standard 3 inch firing tubes.

(i) The leads and electronic components are such that insertion of R.F. signals into the the igniters 129 is minimized for normally expected R.F. frequencies onboard submarine vessels.

(j) The bore riding bolt 99 is internally threaded as shown to enable pressure testing and subsequent sealing of the submarine flare in accordance with military standards.

(k) Zones 89, 91 and 93 are designed to generally conform with International standards for safety.

In relation to point (i) above it is noted that because the flare casing 1 is of aluminium it essentially R.F. shields the electronic components and any leads therein. The only source of R.F. input into the igniters 129 is via the nose 25. The leads of the igniters present an aerial of about 2 cm in length. The maximum susceptibility for this length is 7.5 GHz and the induced maximum power is calculated at 0.2 watts. This effect is reduced either by the inclusion of a wire mesh 271 of small mesh size underneath the perforated end cap 115 on the propulsion medium 85 or by ensuring that the diameter of the apertures 113 is 4 mm or less which is sufficient to enable gas eflux and is the maximum permissible size to eliminate this source of energy.

(c) Pyrotechnic Components

It is only after the submarine flare arrives at the surface of the sea and the electronic circuits 269 indicate a suitable firing condition exists that launch can occur. The reliability and performance of the package then becomes entirely dependent upon explosive logic. At the sea surface, the propellant medium 85 accelerates the payload 49 to a velocity of 100 meters per second before leaving the flare casing 1 environment. Simultaneously, a pyrotechnic delay in the time delay means 87 is ignited and is used to delay the ignition of the flare composition 5 and its separation from the cardboard tube 61 at the maximum height in the trajectory. The necessary delay has been designed so as to permit the time delay means 87 to survive the high velocity water impingement that occurs immediately after the pay load 49 exits the mouth of the flare casing 1. This effect can be particularly noticeable when the device is operated from turbulent sea surface conditions. Thus, the delay allows the flare composition 5 to clear the water and to allow any insuing water particles to be displaced without quenching of the fuse medium 121.

The gaseous products which are generated on ignition of the propulsion medium 85 are directed in a controlled flow onto the flare casing 1. The propulsion medium 85 is burnt at high pressure and vented through twenty 3 mm diameter apertures 113 in the end cap 115 (see FIG. 5). Two of the apertures 113 are oriented below the two time delay means 87.

The time delay means 87 includes an approximate six second delay element, which comprise the previously mentioned fuse medium 121. These fuse mediums 121 ignite a priming composition 273 situated near the base of the flare composition 5. The flare composition 5 can thus be ignited by the burning priming composition 273.

The time delay means 87 comprises a gunpowder priming portion 275 which has a central bore to facilitate ignition from the propulsion medium 85. The gunpowder priming portion 275 then communicates with a 0.7 second primary delay fuse of gunpowder which provides for high volumes of gas to be emitted. It is noted that the 0.7 second delay fuse 277 is within an elongate and narrow passageway 279. This is to inhibit water particles from passing up the passageway 279 to extinguish the 0.7 second delay fuse 277. The high gas volume of fuse 277 thus inhibits entry of water. The time delay means 87 then has a 5.8 second secondary fuse. The 5.8 second fuse 121 is typically of SR651.

The flare composition comprises approximately 700 grams of pyrotechnic composition which is selected to emit either a red, a green or a yellow light. The diameter of the outer tube 77 which contains the flare composition 5 is approximately 6.1 cm. The priming composition 273 can conveniently be SR252.

Charts are set out below showing typical compositions of the Pyrotechnic devices.

-continued

| FUZE DELAY COMPOSITIONS | |
|---|---|
| Secondary Delay 5.8 sec | SR651 |
| Flare Igniter | SR41 (Loose) |

The parachute 9 can conveniently be of any suitable configuration. One particularly preferred parachute is made from a ripstop nylon to U.S. Specification No. F111 and has a surface diameter of 915 mm and is capable of withstanding temperatures to 190° C. It has a wet strength of approximately 90% of its dry value. The descent rate of the configuration has been measured at 2.8 meters per second with half burnt pyrotechnic loads of 0.35 kg.

Referring now to FIG. 23 there is shown one proposed modification to the submarine flare to enable enhanced production. In this embodiment the cardboard tube 61 of the previous embodiment can be replaced with a rigid plastics cup-shaped member 61'. The time delay means 87 can be arranged to fit in the tail end of the tube 61'. Recesses 283 can be provided in the tail end to reduce the plastics material and to physically lighten the structure. The tube 61' is arranged to neatly fit within the flare casing 1. The lead 41 which connects with the sensor 23 can pass down through an opening 285 at the tail end of the tube 61'.

The propulsion medium 85 can be retained in a metallic enclosure 287 fabricated from parts 289 and 291 which can be nested one within the other and so that the part 289 crimps over part 291 thereby holding the propulsion medium 85 captive therein. Metallic guides 293 can be provided to align with the apertures 295 in the part 289 and with the time delay means 87.

A plug 297 can be provided behind the metallic enclosure 287 and the plug 297 can be provided with "O" rings 301 to effectively seal the lead 41 and the grommet 131. This modification allows for a more compact struc-

FLARE COMPOSITIONS

| | SR524 | SR170A | SR91 | SR703 | SR193 | EDG(A) |
|---|---|---|---|---|---|---|
| Magnesium | 58 | 48 | 35 | 42 | 36 | 39 |
| Boron | — | — | — | — | — | 6 |
| Sodium Nitrate | 38 | — | — | — | — | — |
| Barium Nitrate | — | — | — | 15 | 46 | 50 |
| Strontium Nitrate | — | — | 41 | — | — | — |
| Strontium Oxalate | — | 10 | — | — | — | — |
| Potassium Perchlorate | — | 38 | — | 25 | — | — |
| Chlorinated Binder | — | — | 20 | 12 | 18 | — |
| Linseed Oil | 4 | 4 | 4 | 6 | — | 5 |
| Flare Intensity $Cd$ $1 \times 10^5$ | 1.072 | 418 | 143 | 170 | 220 | 320 |

PROPULSION MEDIUM
CHARGE CHARACTERISTICS G12 GUNPOWDER

| Charge wt. G12 Gunpowder | Muzzle Velocity m/sec | Payload height meters lkg Mass |
|---|---|---|
| 8 | 75 | 110 |
| 10 | 82 | 135 |
| 12 | 88 | 165 |
| 14 | 102 | — |

VISIBLE RANGE

| Flare Material | | | Visible Range of Flare Statute Miles Sky Conditions | | | | |
|---|---|---|---|---|---|---|---|
| Composition | Colour | Intensity (Candella) | Clear | Light | Heavy | Twilight | Starlight |
| SR524 | Yellow | $1 \times 10^6$ | 13.4 | 21.5 | 28.5 | 32.9 | 46.0 |
| SR91 | Red | $1.5 \times 10^5$ | 8.5 | 14 | 20 | 26 | 38 |
| SR107A | Red | $4 \times 10^5$ | 11 | 17 | 33 | 36 | 42 |
| SR701 | Green | $1 \times 10^5$ | 7.3 | 13 | 18 | 25 | 36 |
| SR193 | Green | $2 \times 10^5$ | 10 | 15 | 21 | 28 | 40 |
| EDG(A) | Green | $3.2 \times 10^5$ | 16 | 22 | 28 | 36 | 45 |

| FUZE DELAY COMPOSITIONS | |
|---|---|
| Primary Igniter | Sulphurless mealed Gunpowder GD90 |
| Primary Delay 7.00 millisecond | SR43 |

ture where the propulsion medium 85 can be preassembled independent of any mechanical assemblies of the submarine flare. In addition, the plug 297 provides a seal for inhibiting the ingress of water to the pyrotechnic materials.

Many modifications may be made to the embodiments described above without departing from the ambit of the invention. The nature of the modifications are such as would be within the general skills of persons working in the engineering arts and/or pyrotechnic arts.

We claim:

1. A flare for underwater vessel use that can be launched from below the surface of a body of sea water comprising an elongated buoyant casing, a projectable tubular body located in the casing containing a flare composition which body can be projected from the casing into the air when the casing is at or near the surface of the water, propulsion means for projecting said tubular body from the casing, means for igniting the flare composition after the body is projected into the air to provide a visible display in the air, and control means for activating the propulsion means when the casing is at or near the surface of the water and for igniting the flare composition when the body is in the air, said control means including inclination means for sensing the vertical orientation of the casing that permit the propulsion means to be activated only when the vertical orientation of the casing is within a prescribed range of vertical attitude, said casing being deployable from a firing tube on the vessel from a location beneath the surface of the water, its buoyancy carrying it to the surface where the tubular body containing the flare composition can be projected therefrom.

2. The flare of claim 1, wherein said inclination means comprises a switch means which conducts electric current therethrough when said flare is within said range of vertical attitude.

3. The flare of claim 2, wherein said switch means comprises a pair of spaced electrical contacts and an electrically conducting liquid that bridges said contacts when said flare is within said range of vertical attitude.

4. The flare of claim 3, wherein said switch means is a mercury switch.

5. The flare of claim 1, wherein said control means includes an electric circuit and said inclination means allows electric current to pass to said electric circuit when said casing is within said range of vertical attitude, said electric circuit forming part of said propulsion means for projecting said body into the air.

6. The flare of claim 1, wherein said control means includes means for sensing when the forward end of the casing is above the surface of the water, said sensing means inhibiting activation of the propulsion means until said forward end is above the surface of the water.

7. The flare of claim 5, wherein said control means includes means for sensing when the forward end of the casing is above the surface of the water, said sensing means inhibiting activation of the propulsion means until said forward end is above the surface of the water and comprising spaced electrode means, at least one of which will be located above the surface of the water when the casing is floating at the surface, sensing electric circuit means connected to said spaced electrode means for measuring the electrical current flow therebetween and for detecting a change in said current flow when said forward end is above the surface of the water.

8. The flare of claim 7, wherein said spaced electrode means comprises a first electrode at the forward end of said casing and a second electrode at a remote location therefrom.

9. The flare of claim 8, wherein the casing is electrically conducting, the first electrode being mounted in the forward end of the casing which is electrically insulated from the casing and said second electrode being the casing.

10. The flare of claim 8, wherein said first electrode is the negative electrode and said casing is the positive electrode.

11. The flare of claim 1, wherein said propulsion means for projecting said body into the air is a pyrotechnic medium, said body having time delay means therein activated by said pyrotechnic medium for delaying activation of the means for igniting the flare composition until said body has at least cleared the surface of the water.

12. The flare of claim 1, wherein said time delay means also includes a pyrotechnic medium.

13. The flare of claim 12, wherein said time delay means is mounted in said tubular body between said propulsion means for projecting said body into the air and said flare composition, so that when said pyrotechnic medium of the propulsion means is ignited to project said body into the air, the pyrotechnic medium of said time delay means will be ignited to delay igniting said flare composition.

14. The flare of claim 13, wherein said pyrotechnic medium of the time delay means comprises an ignitable priming portion located adjacent said propulsion means that projects said body into the air, a primary delay fuse portion adjacent said priming portion, a secondary delay fuse portion adjacent said primary delay fuse portion, and a flare composition igniter portion adjacent said secondary delay fuse portion.

15. The flare of claim 14, wherein said priming portion includes a central bore at the end adjacent said propulsion means to facilitate ignition thereof by said propulsion means.

16. The flare of claim 15, wherein said primary delay fuse portion is mounted within an elongated passageway and is of a material which will generate sufficient volumes of gas to inhibit water particles from passing up said elongated passage to extinguish said primary delay fuse portion.

17. The flare of claim 13, including an end cap between said propulsion pyrotechnic medium and said time delay means, said end cap having apertures therein to allow gas pressure to be applied to said body to cause it to be projected into the air, and wherein said time delay means in the body is arranged over at least one of said apertures.

18. The flare of claim 11, wherein said time delay means provides a time delay of approximately 6 seconds.

19. The flare of claim 5, wherein said control means includes hydrostatic valve means in said casing which open at or near the surface of the water and salt water battery means to provide electric power to the electric circuit of the propulsion means, said valve means when open allowing sea water to contact the battery means and activate it.

20. The flare of claim 19, wherein said hydrostatic valve means is held in a closed position to prevent sea water from contacting said salt water battery means by a latch mechanism which is deactivated as the casing is deployed from the firing tube.

21. The flare of claim 20, wherein said latch mechanism includes a primary latch mechanism for holding the valve means closed and a secondary latch which inhibits said primary latch mechanism from being placed in a condition to be deactivated until said casing and secondary latch are within the firing tube from which said casing is to be deployed.

22. The flare of claim 21, wherein said primary latch mechanism and said secondary latch are interconnected and including a priming plug at a tail end of said casing which holds both said primary latch and said secondary latch in an inoperative position, until said priming plus is removed.

23. The flare of claim 22, wherein said priming plug is releasably keyed to said casing and wherein said priming plug holds said hydrostatic valve means in a closed position to prevent sea water from contacting said salt water battery means, thereby relieving the primary latch mechanism of this function until it is unkeyed and removed from said casing.

24. The flare of claim 21, wherein said primary latch mechanism extends outwardly from a side wall of said casing placing it in a position to be deactivated so that, in use, it can be located in a blind keyway extending along the length of said firing tube, and be deactivated when it reaches the blind end of said keyway as the casing is being deployed.

25. The flare of claim 24, wherein said secondary latch is biased by spring means to extend outwardly from a side wall of said casing and while in this extended position to hold said primary latch mechanism inwardly of the side wall of the casing to prevent accidental or unintentional deactivation of it.

26. The flare of claim 25, wherein said secondary latch is, in use, inhibited from extending fully from the side wall of the casing when said casing is fully within said firing tube by said secondary latch engaging with the side walls of said firing tube and holding said secondary latch from fully extending from said casing.

27. The flare of claim 26, wherein said primary latch mechanism and said secondary latch are located diametrically opposite each other across said casing.

28. The flare of claim 27, wherein said primary latch mechanism engages with a plug which, in turn, engages with said hydrostatic valve means.

29. The flare of claim 28, wherein said primary latch mechanism includes a "U" shaped spring member located at the tail end of said casing, said spring member being biased against said plug to apply spring pressure to said plug to hold said hydrostatic valve means closed and wherein when said primary latch mechanism is deactivated, said spring member is moved to a position where said plug can be displaced relative to said hydrostatic valve means to enable said hydrostatic valve means to open.

30. The flare of claim 29, wherein said spring member is pivotally mounted at one end on one side of said casing so that it swings about said side when said primary latch mechanism is deactivated to assume a position outwardly and rearwardly of the tail end of said casing.

31. The flare of claim 30, wherein said secondary latch is mounted to swing about said end of said "U" shaped spring member.

32. The flare of claim 31, wherein said primary latch mechanism swings about a rod carried on the arms of said "U" shaped spring member and slides along the length thereof and wherein said rod engages with a depression in the side of said casing diametrically opposite where said end of said "U" shaped spring member is pivotally mounted, and wherein when said primary latch mechanism is deactivated, it moves said rod out of engagement with said depression to allow said "U" shaped spring member to swing.

33. The flare of claim 32, wherein said primary latch mechanism and said secondary latch are interconnected by a spring carriage assembly extending spaced from but generally parallel to the longitudinal axis of said "U" shaped spring member.

34. The flare of claim 33, wherein said spring carriage member applies spring pressure to push said primary latch mechanism to extend outwardly from said casing when said secondary latch is held within said casing by the side wall of the firing tube.

35. The flare of claim 34, wherein said secondary latch and said primary latch mechanism are both held within said casing by the spring of said carriage assembly being compressed and wherein when said spring is not compressed, said spring urges said primary latch mechanism to extend outwardly from said casing when said secondary latch is within said casing.

36. The flare of claim 35, including a further spring member biasing said secondary latch to extend outwardly from said casing, said further spring member engaging with said "U" shaped spring member and secondary latch.

* * * * *

UNITED STATES PATENT AND TRADEMARK OFFICE

CERTIFICATE OF CORRECTION

PATENT NO. : 5,044,281

DATED : September 3, 1991

INVENTOR(S) : Peter RAMSEY et al.

It is certified that error appears in the above-identified patent and that said Letters Patent is hereby corrected as shown below:

Claim 12, column 20, line 20, change "claim 1" to --claim 11--.

Signed and Sealed this

Fifth Day of January, 1993

*Attest:*

DOUGLAS B. COMER

*Attesting Officer*

*Acting Commissioner of Patents and Trademarks*